US005360287A

United States Patent [19]

Laditka

[11] Patent Number: 5,360,287

[45] Date of Patent: * Nov. 1, 1994

[54] METHODS AND APPARATUS FOR DISPENSING, MIXING AND APPLYING COATING CONSTITUENTS TO TRAFFIC SURFACES, AND TRAFFIC SURFACES COATED USING SUCH METHODS

[76] Inventor: Alexander Laditka, 4741 Dalebridge #C-10, Warrensville Hts., Ohio 44128

[ * ] Notice: The portion of the term of this patent subsequent to Feb. 4, 2009 has been disclaimed.

[21] Appl. No.: 134,371

[22] Filed: Oct. 12, 1993

Related U.S. Application Data

[63] Continuation-in-part of Ser. No. 829,956, Feb. 3, 1992, Pat. No. 5,251,998, which is a continuation-in-part of Ser. No. 586,909, Dec. 10, 1991, Pat. No. 5,085,537, which is a continuation-in-part of Ser. No. 368,084, Jun. 19, 1989, Pat. No. 4,958,955, which is a continuation of Ser. No. 213,449, Jun. 28, 1988, abandoned, which is a continuation of Ser. No. 85,253, Aug. 11, 1987, abandoned, which is a continuation of Ser. No. 892,337, Aug. 1, 1986, abandoned, which is a continuation-in-part of Ser. No. 532,742, Sep. 16, 1983, Pat. No. 4,603,999, which is a continuation-in-part of Ser. No. 408,484, Aug. 16, 1982, Pat. No. 4,477,203.

[51] Int. Cl.[5] ..... E01C 7/06; E01C 23/08; E01C 19/22

[52] U.S. Cl. ..... 404/75; 404/92; 404/101; 404/112

[58] Field of Search ..... 404/75–76, 404/108–113; 299/40–41; 280/263; 222/529, 545; 251/8, 10, 121; 188/15–16; 366/345–346

[56] References Cited

U.S. PATENT DOCUMENTS

| | | | |
|---|---|---|---|
| 782,459 | 2/1905 | Morris . | |
| 831,494 | 9/1906 | Alexander . | |
| 1,224,294 | 5/1917 | Franzen . | |
| 1,437,863 | 12/1922 | Raymond . | |
| 1,591,682 | 7/1926 | Ponselle . | |
| 1,914,950 | 6/1933 | Kanen . | |
| 2,033,510 | 3/1936 | Brayley | 16/24 |
| 2,175,511 | 10/1939 | Wahlstrom et al. . | |
| 2,200,921 | 5/1940 | Granell | 51/177 |
| 2,241,214 | 5/1941 | Milster | 188/152 |
| 2,277,389 | 3/1942 | Conway . | |
| 2,668,976 | 2/1954 | Beach | 15/230 |
| 2,717,725 | 9/1955 | Bennett | 222/485 |
| 2,725,945 | 12/1955 | Beaudoux et al. | 180/6.24 |
| 2,754,733 | 7/1956 | Beyer . | |
| 2,779,965 | 2/1957 | Schilberg | 16/26 |
| 2,796,202 | 6/1957 | Lawrence et al. | 222/233 |

(List continued on next page.)

FOREIGN PATENT DOCUMENTS

| | | | |
|---|---|---|---|
| 945037 | 12/1963 | United Kingdom | 15/49 R |

*Primary Examiner*—Kenneth J. Dorner
*Assistant Examiner*—Nancy Mulcare
*Attorney, Agent, or Firm*—David A. Burge

[57] ABSTRACT

An apparatus for dispensing, mixing and applying coating constituents to traffic surfaces has a carriage to which are connected 1) at least portions of a dispensing system that serves to dispense coating constituents from one or more reservoirs onto traffic surface portions that are to be coated, and 2) at least one rotatable set of mixing and applicator tools that extend in a radial array beneath the carriage. A wheel supported vehicle such as a truck or tractor is connectable to the carriage for guiding and moving the carriage across traffic surface areas that are to be coated. The vehicle also may be used 1) to support at least portions of the carriage, 2) to support at least portions of vehicle-connected components of the apparatus, and/or 3) to provide a source of power or to support at least portions of a source of power for operating vehicle-connected and/or carriage-connected components of the apparatus. Other aspects of the invention relate 1) to the advantageous utilization of various combinations of vehicle-connected and carriage-connected coating apparatus components to dispense, mix and uniformly apply coating constituents to traffic surface areas, and 2) to traffic surface areas that are coated as a result thereof.

32 Claims, 7 Drawing Sheets

U.S. PATENT DOCUMENTS

| | | | |
|---|---|---|---|
| 2,796,203 | 7/1957 | Masters et al. | 222/311 |
| 2,799,037 | 7/1957 | Grogan | 15/172 |
| 2,835,420 | 5/1958 | Foley | 222/485 |
| 2,962,946 | 12/1960 | Neff . | |
| 3,130,653 | 4/1964 | Talbott . | |
| 3,153,992 | 10/1964 | Dabelle . | |
| 3,183,803 | 5/1965 | Gierhart . | |
| 3,187,845 | 6/1965 | Ashley, Jr. et al. | 188/16 |
| 3,206,174 | 9/1965 | Young | 259/149 |
| 3,221,619 | 12/1965 | Erickson . | |
| 3,241,976 | 3/1966 | Rank et al. . | |
| 3,245,329 | 4/1966 | Nagin et al. . | |
| 3,279,337 | 10/1966 | Weaver . | |
| 3,283,675 | 11/1966 | Gifford et al. . | |
| 3,305,887 | 2/1967 | Turner | 15/50 |
| 3,333,518 | 8/1967 | Sholl et al. . | |
| 3,452,381 | 7/1969 | Bratti | 15/98 |
| 3,458,885 | 8/1969 | Danielsson | 15/50 |
| 3,515,041 | 6/1970 | Murtaugh . | |
| 3,533,336 | 10/1970 | Wikel . | |
| 3,550,866 | 12/1970 | Swenson | 239/677 |
| 3,559,543 | 2/1971 | Schwoebel, Jr. . | |
| 3,580,638 | 5/1971 | Pullen | 299/25 |
| 3,683,761 | 8/1972 | Babic . | |
| 3,703,856 | 11/1972 | Wikel et al. . | |
| 3,771,893 | 11/1973 | Miller | 404/101 |
| 3,776,430 | 12/1973 | Grandrud | 222/177 |
| 3,791,754 | 2/1974 | Zochil | 404/112 |
| 3,807,634 | 4/1974 | Vogt | 239/150 |
| 3,841,779 | 10/1974 | Ray | 404/111 |
| 3,936,212 | 2/1976 | Holz, Sr. et al. | 404/112 |
| 3,989,403 | 11/1976 | Verive | 404/111 |
| 4,074,385 | 2/1978 | Howard et al. | 15/180 |
| 4,096,879 | 6/1978 | Serur et al. | 137/391 |
| 4,172,580 | 10/1979 | Raftis et al. | 251/8 |
| 4,302,127 | 11/1981 | Hodson | 404/102 |
| 4,302,128 | 11/1981 | Thatcher | 404/111 |
| 4,315,700 | 2/1982 | Heiligtag et al. | 404/111 |
| 4,318,631 | 3/1982 | Vickers | 404/93 |
| 4,350,293 | 9/1982 | Lestradet | 239/155 |
| 4,357,953 | 11/1982 | Patterson | 137/88 |
| 4,365,377 | 12/1982 | Todd et al. | 15/98 |
| 4,477,203 | 10/1984 | Laditka | 404/111 |
| 4,603,999 | 8/1986 | Laditka | 404/112 |
| 4,958,955 | 9/1990 | Laditka | 404/75 |
| 5,085,537 | 2/1992 | Laditka | 404/75 |
| 5,251,998 | 10/1993 | Laditka | 404/72 |

130
184
184
182
18
27
18
13
13
22
35
38
62
63
155
64
65
33
165
165
190
190
40
87
160
290
66
160
67
100
113
95
100
110
112
103
102
53
300
290
51
310
50
125
96
32
165
310
165
14
420
450
70
440
477
97
370
296
98
410
425
99
28
34
355
29
294
430
390
392
19
375
377
375
350
331
400
405
375
394
330
21
23
130
21
17
377
15
360
396
340
21
355
21
26
29
28
295
16
16
23
296
510
20
510
22
522
10

523
500
500

METHODS AND APPARATUS FOR DISPENSING, MIXING AND APPLYING COATING CONSTITUENTS TO TRAFFIC SURFACES, AND TRAFFIC SURFACES COATED USING SUCH METHODS

Cross-Reference to Related Patents and Applications

The present application is a continuation-in-part of application Ser. No. 07/829,956 filed Feb. 3, 1992 (issued Oct. 12, 1993 as U.S. Pat. No. 5,251,998—referred to hereinafter as the Fifth Parent Case), which was filed as a continuation in part of application Ser. No. 07/586,909 filed Dec. 10, 1991 (issued Feb. 4, 1992 as U.S. Pat. No. 5,085 537—referred to hereinafter as the Fourth Parent Case), which was filed as continuation-in-part of application Ser. No. 07/368,084 filed Jun. 19, 1989 (issued Sep. 25, 1990 as U.S. Pat. No. 4,958,955—referred to hereinafter as the Third Parent Case) , which was filed as a continuation of Ser. No. 07/213,449 filed Jun. 28, 1988 (abandoned), which was filed as a continuation of Ser. No. 07/085,253 filed Aug. 11, 1987 (abandoned), which was filed as a continuation of Ser. No. 06/892,337 filed Aug. 1, 1986 (abandoned), which was filed as a continuation-in-part of Ser. No 06/532,742 filed Sep. 16, 1983 (issued Aug. 5, 1986 as U.S. Pat. No. 4,603,999—referred to hereinafter as the Second Parent Case), which was, in turn, filed as a continuation-in-part of Ser. No. 06/408,484 filed Aug. 16, 1982(issued Oct. 16, 1984 as U.S. Pat. No. 4,477,203—referred to hereinafter as the First Parent Case) the disclosures of all of the aforementioned being incorporated herein by reference.

The invention disclosed and claimed herein is the work product of a continuing development effort that resulted in the inventions of the First, Second, Third, Fourth and Fifth Parent Cases (referred to collectively hereinafter as the Parent Cases), and that provides a number of improvement features that can be used separately from or in conjunction with features of the inventions of one or more of the Parent Cases.

BACKGROUND OF THE INVENTION

1. Field of the Invention

The present invention relates to methods and apparatus for dispensing, mixing and applying coating constituents to form desired types of coatings on relatively large surface areas that characteristically are referred to as "traffic surfaces," typically roadway surfaces such as highways, streets, driveways, parking lots, runways, taxiways, and tarmacs and the like; and, the invention relates to traffic surfaces that are coated by utilization, of the methods hereof. Aspects of the invention relate to the utilization of a wheel-supported vehicle such as a truck or tractor that is connectable to a carriage of the apparatus 1) for moving the carriage across traffic surface areas that are to be coated, 2) for supporting at least portions of the carriage, 3) for supporting at least portions of such apparatus components as may be connected to the vehicle, and/or 4) for providing a source of power or support for at least portions of a source of power that is used to operate selected components of the apparatus. Other aspects of the invention relate to the utilization of various combinations of vehicle-connected and carriage-connected components of a coating apparatus to dispense, mix and uniformly apply coating constituents to traffic surface areas, and to traffic surface areas that are coated as a result thereof.

2. Prior Art

In the present document, the term "traffic surface" is used in a generic sense to refer to a wide class of substantially horizontal surfaces such as highways, streets, driveways, parking lots, runways, taxiways, tarmacs, floors of large garages and industrial buildings, loading dock decks, and the like that need to be coated from time to time to protect, restore and enhance surface integrity.

Because traffic surfaces are exposed to wear and often to the effects of the elements, they are subject to deterioration and periodically require the application of coatings to protect, restore and enhance their integrity, and to thereby extend their useful lives. Some traffic surfaces should be coated when constructed, as by the application of a coating that seals exposed surfaces and thereby protects against water penetration that, in winter, can cause spalding or cracking. Many traffic surfaces require protective and reconditioning coatings periodically and/or after the surfaces have been subjected to a certain amount of use.

While the prior art presents many proposals that seek to address needs that are encountered in applying coating constituents to traffic surfaces, a need nonetheless remains for a vehicle-connectable coating apparatus that advantageously and efficiently utilizes a transport carriage together with other components such as a dispensing system for regulating the dispensing of coating constituents from a reservoir onto traffic surface portions that are located centrally beneath the carriage, and a suitable means for selectively providing drive energy to components of the apparatus that include a power driven set of rotary tools that extend in a radial array beneath the carriage for mixing, spreading and applying dispensed coating constituents with consistently good uniformity onto traffic surface portions that are engaged by the rotary tools as the carriage is moved across a traffic surface.

THE REFERENCED PARENT CASES

The referenced First Parent Case, U.S. Pat. No. 4,477,203, discloses an apparatus for dispensing plural coating constituents from separate reservoirs that are supported atop a wheeled carriage, with an power-driven array of rotary tools being provided to mix, spread and apply the coating constituents after they have been dispensed. The referenced Second Parent Case, U.S. Pat. No. 4,603,999, discloses an apparatus that utilizes a roller or wheel supported carriage to position an array of power-driven rotary tools to effect "finishing" of coating constituents applied to a traffic surface.

The referenced Third Parent Case, U.S. Pat. No. 4,958,955, discloses an apparatus that utilizes a plurality of arrays of power-driven rotary tools to mix, spread and apply dispensed coating constituents to traffic surfaces. The referenced Fourth Parent Case, U.S. Pat. No. 5,085,537, discloses an apparatus that utilizes a hollow shaft to centrally support an array of power-driven rotary tools, and that utilizes a center-fed system for dispensing coating constituents through the hollow shaft.

The referenced Fifth Parent Case, U.S. Pat. No. 5,251,998, discloses a carriage-mounted power source that provides for coordinated operation of carriage-connected, power-driven components at appropriate relative speeds of rotation to facilitate the application of coating constituents to traffic surfaces in a desired manner with desired uniformity. Methods that utilize various features of these inventions also are disclosed by the referenced Parent Cases.

While the referenced Parent Cases make mention of the possibility that the sets of rotary tools that are used by their coating systems can be vehicle-mounted and/or vehicle-connected, coating apparatus that are disclosed by the Parent Cases as embodying their preferred forms of practice are principally self-powered, self-propelled units that are intended to function at a job site without being connected to any auxiliary form of wheeled vehicle. Not specifically addressed by the inventions of the referenced Parent Cases is the need for power operated coating apparatus that, in its preferred form, is connectable to a wheeled vehicle not only for purposes of being transported between job sites but also during use at job sites—a coating apparatus that specifically takes advantage of and utilizes features of a vehicle so that, when the apparatus is connected to a wheeled vehicle for use at a job site, the coating apparatus cooperates advantageously with the vehicle to provide a coating system that performs well in depositing plural coating constituents on a traffic surface, in mixing the deposited constituents in situ, and in applying the coating constituents to put in place a coating of desired uniformity.

While the system of the present invention may, in some modes of practice, make use of a number of features that are disclosed in one or more of the referenced Parent Cases, the system of the present invention provides an improved combination of features that extends beyond the scope of the referenced Parent Cases.

SUMMARY OF THE INVENTION

The present invention addresses the foregoing and other drawbacks of the prior art by providing novel and improved methods and apparatus for dispensing, mixing and applying coating constituents to traffic surfaces; and by providing resulting surface coatings that are desirably characterized by consistently good uniformity.

In its simplest form, the system of the present invention provides a coating apparatus (preferably of the general type disclosed in the referenced Fifth Parent Case) that relies on a wheeled vehicle in order to be towed or otherwise moved along a forward path of travel across traffic surface portions that are to be coated by the apparatus. In more preferred forms, the system of the present invention provides coating apparatus (preferably having components of the general type disclosed in the referenced Fifth Parent Case) that relies on a wheeled vehicle to serve as source of rotary energy and/or to carry at least selected portions of a source of rotary energy for driving selected components of the apparatus, and/or to support or to assist in supporting a main frame or carriage of the apparatus and/or selected components of the apparatus.

Stated in another way, the system of the present invention advantageously utilizes a wheel-supported vehicle such as a truck or tractor 1) to provide power to operate selected components of a coating apparatus, 2) to carry at least portions of a source of power for operating selected components of a coating apparatus, 3) to support at least selected components of a coating apparatus, 4) to support at least portions of a main frame or carriage of a coating apparatus—which carriage, in turn, also serves to support selected coating apparatus components—and/or 5) to guide and move the various components of a coating apparatus in unison along a forward path of travel that extends across traffic surface portions that are to be coated by the apparatus.

An apparatus that embodies the best mode known to the inventor for carrying out the preferred practice of this invention utilizes features that are disclosed in one or more of the referenced Parent Patents, with preference being given to utilization of components of the system that is disclosed in the Fifth Parent Patent, to provide a vehicle-connectable coating system that is capable, concurrently, 1) of maintaining homogeneity of reservoir-carried coating constituents prior to their being dispensed, 2) of dispensing, mixing, spreading and applying coating constituents on smooth and/or irregular traffic surfaces, 3) of mixing, spreading and applying dispensed coating constituents as by utilizing at least one set of rotary tools that are rotated about a substantially vertically extending center axis, 4) of dispensing coating constituents from the reservoir in a regulated, "center fed" manner as by ducting the coating constituents downwardly through a hollow shaft that centrally mounts the rotary tools, so that the coating constituents are discharged onto the traffic surface at a central location amidst the set of rotary tools for being engaged by the tools as the apparatus moves across the traffic surface, and 5) of coordinating these concurrent functions so that desired types of coating applications are provided that are characterized by consistently high uniformity.

A method of applying a coating to a traffic surface that embodies the best mode known to the inventor for carrying out the preferred practice of this invention includes several steps that preferably are performed substantially concurrently. A plurality of coating composition ingredients are deposited upon selected portions of a traffic surface that is to be coated. A wheeled vehicle, such as a truck or tractor to which a coating apparatus is connected, is operated to move the vehicle-connected coating apparatus at a controlled forward velocity along a forward path of travel to bring a set of rotary tools of the apparatus into contact with deposited coating composition ingredients.

In carrying out the preferred method, the set of rotary tools that is utilized by the apparatus preferably is of the general type that is disclosed in the referenced Fifth Parent Case in that it includes rotary structure 1) having a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least the selected associated blades are permitted to move a limited amount relative to the associated rotary structure to accommodate the character of said selected portions of the traffic surface to maintain relatively close, substantially parallel contact with such selected portions of the traffic surface as are engaged by the associated blades.

To continue with a description of the method steps that preferably are carried out substantially concurrently, the set of rotary tools is rotated about its associated center axis at a controlled rate of tool rotation, with at least the selected associated blades being urged into substantially continuous contact with said selected portions of the traffic surface and into contact with coating composition ingredients deposited thereon to effect a relatively rapid mixing of the deposited ingredients to achieve a condition of substantially uniform coating consistency. Application of a coating of substantially uniform consistency to the selected traffic surface portions is effected by continuing to rotate the set of rotary tools about its associated center axis, with at least the selected associated blades moving relative to the rotary structure as is needed to conform to the contour of and to substantially maintain contact with said selected traffic surface portions.

At the same time that dispensed, deposited coating constituents are being applied by the blades, mixing of coating constituents preferably is being carried out in a fluid reservoir from which coating constituents are dispensed. A regulated flow of mixed ingredients from the reservoir is ducted to and through a discharge station of the vehicle-connected apparatus to deposit the flow of ingredients onto selected traffic surface portions that underlie the discharge station. As mixing, dispensing, and application of coating ingredients takes place, the vehicle to which the vehicle-connected coating apparatus is coupled is operated to move the coating apparatus along a forward path of travel at a controlled forward velocity to thereby cause the set of rotary tools to engage, mix, spread and apply the deposited ingredients to effect the application of a substantially uniform coating to the contiguous areas of the traffic surface that extend along the forward path of travel.

BRIEF DESCRIPTION OF THE DRAWINGS

The foregoing and other features of the invention will be better understood by referring to the description of the preferred embodiment and the claims which follow, taken together with the accompanying drawings, wherein:

DESCRIPTION OF THE PREFERRED EMBODIMENT

Figure 1:
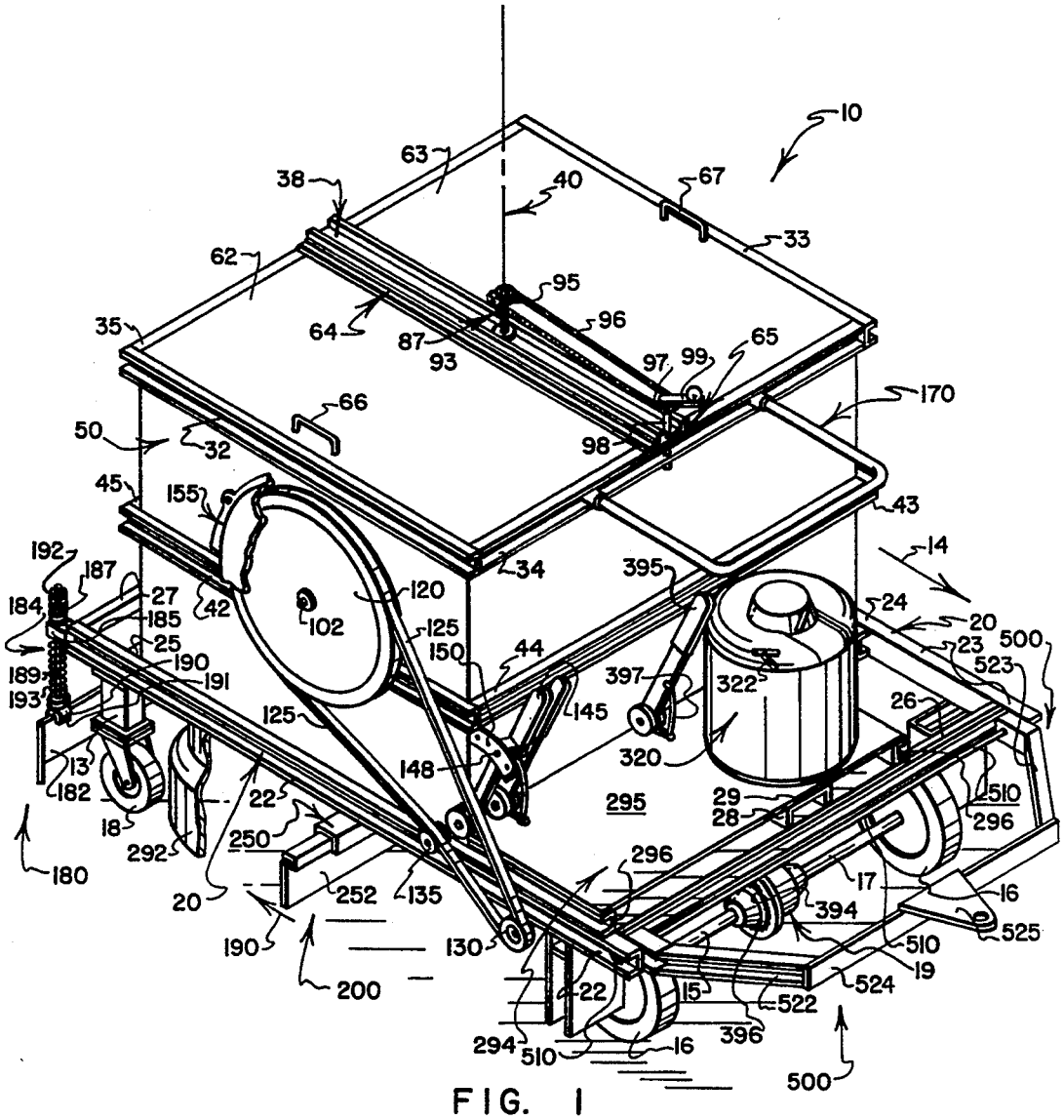
FIG. 1 is a perspective view of a surface finishing apparatus that embodies one form of preferred practice of the present invention, with the apparatus employing a set of rotary tools to mix, spread and apply coating constituents to traffic surface portions that underlie a wheel-supported transport carriage, with the view showing principally top, front and right side portions thereof, and with portions of two protective enclosures removed to permit certain otherwise hidden features to be seen.
Figure 2:
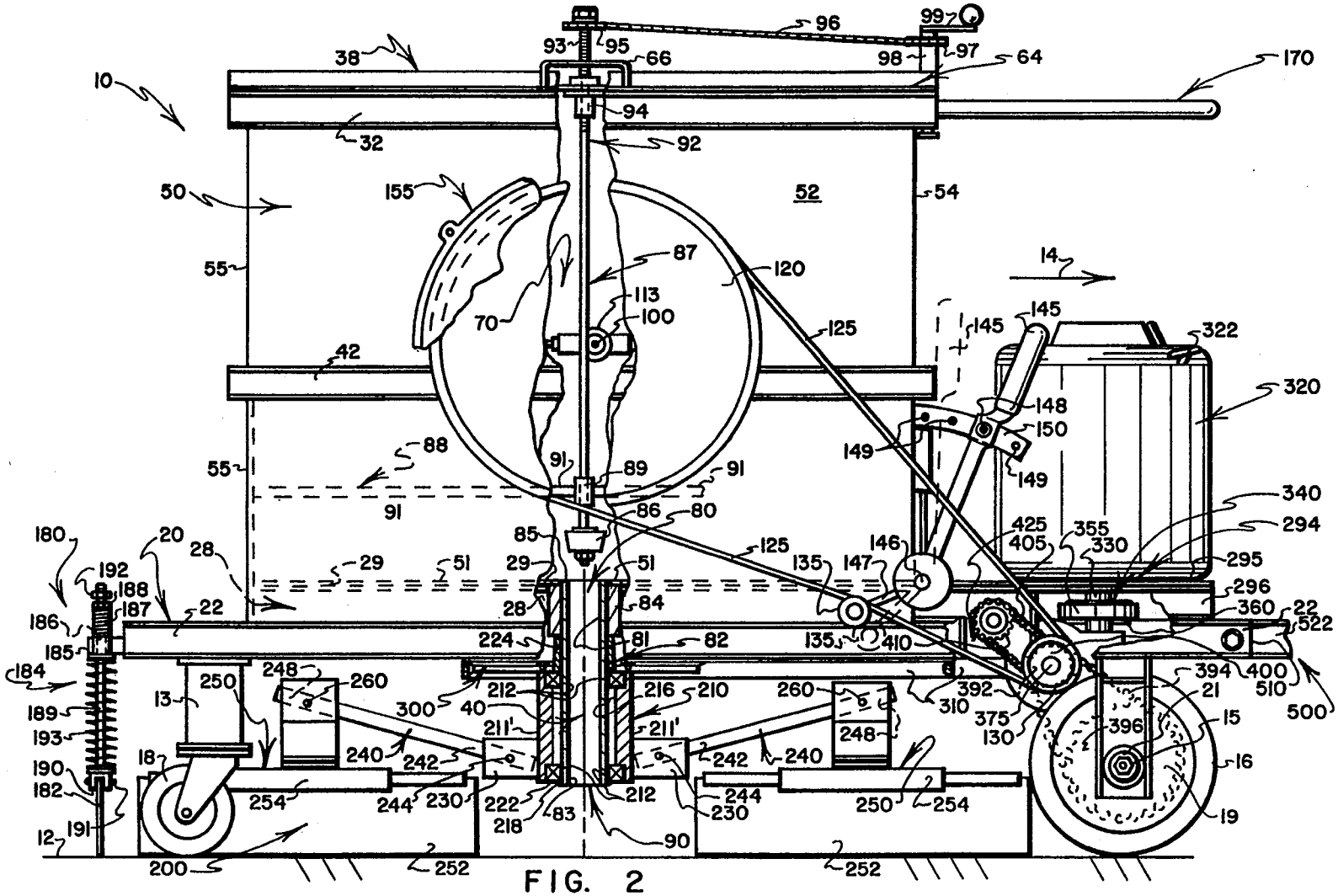
FIG. 2 is a right side elevational view thereof with portions broken away to permit certain otherwise hidden features to be seen, and with a few hidden features depicted by broken lines.
Figure 3:
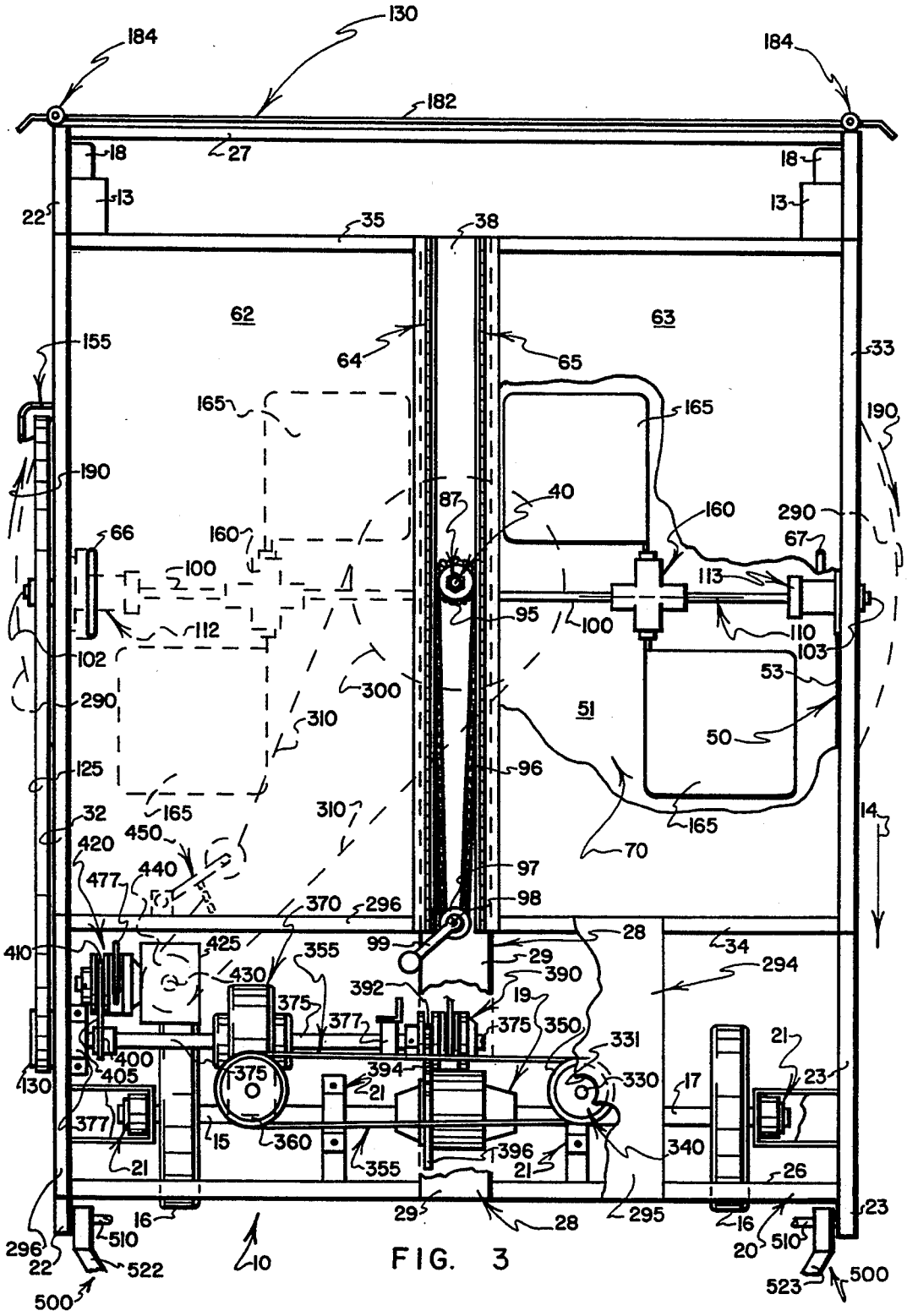
FIG. 3 is a top plan view thereof with portions broken away to permit certain otherwise hidden features to be seen, and with a few hidden features depicted by broken lines.
Figure 4:
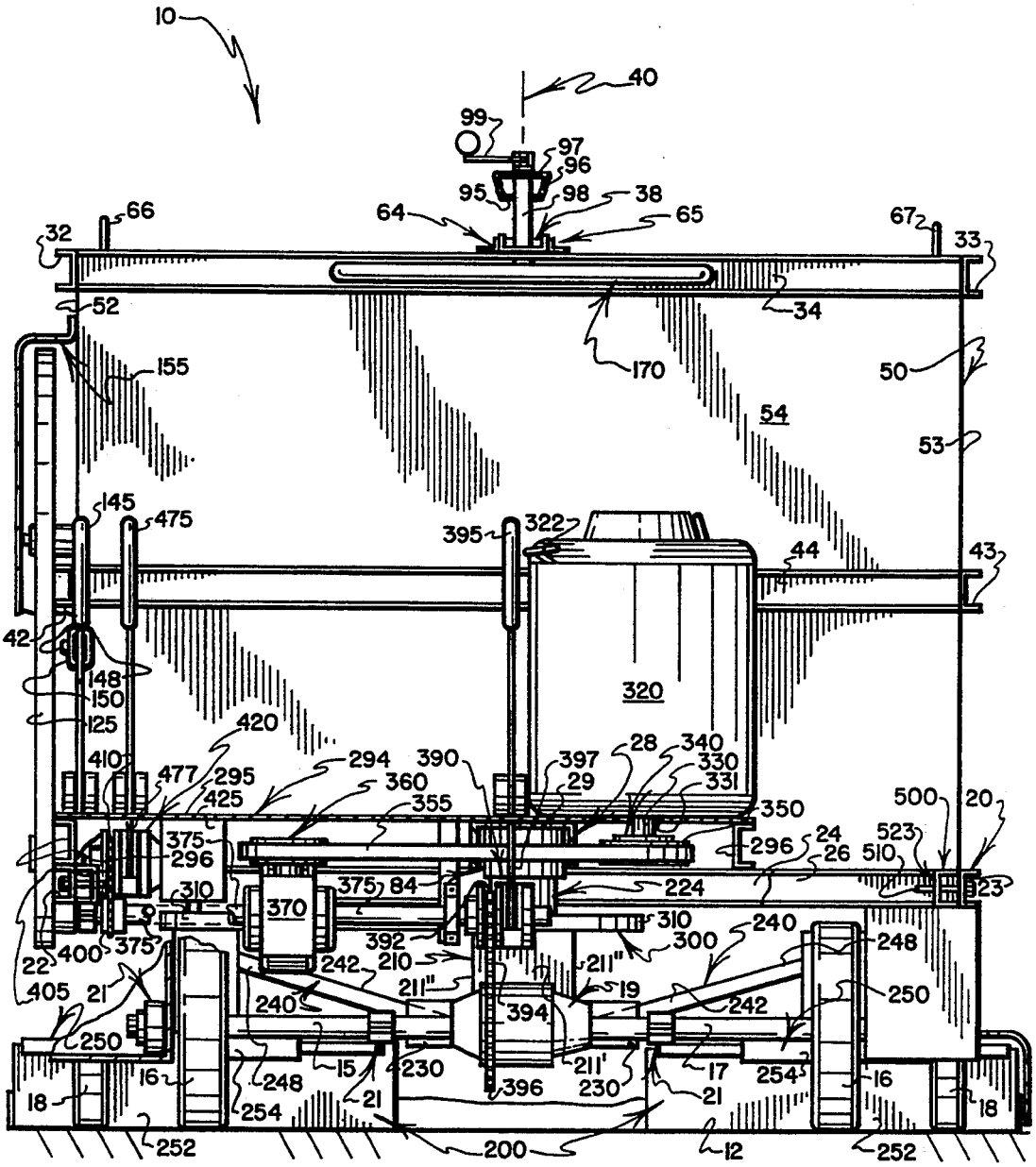
FIG. 4 is a front elevational view thereof with portions broken away to permit certain otherwise hidden features to be seen, and with a few hidden features depicted by broken lines.

Referring to FIGS. 1–4, one preferred form of apparatus or machine for dispensing, mixing, spreading and applying coating constituents to traffic surfaces is indicated generally by the numeral 10. In FIGS. 1, 2 and 4, the machine 10 is shown positioned atop a traffic surface 12. A forward direction of movement of the machine 10 across the traffic surface is indicated in FIGS. 1–3 by the arrow 14.

The machine 10 includes forward and rearward wheels 16, 18, respectively, that underlie and support a carriage structure 20 atop the traffic surface 12. As is best seen in FIG. 3, the forward wheels 16 are mounted on coaxially extending right and left axles 15, 17 that project from opposite sides of a commercially purchased differential unit 19. Carriage-mounted bearings 21 journal the axles 15, 17 for rotation. As is best seen in FIG. 2, the rearward wheels 18 are commercially purchased swivel wheel assemblies that are connected to post-like formations 13 that depend from rear corner regions of the carriage structure 20. The swivel character of the rearward wheels 18 permits the carriage 20 to be "steered" or "guided" as it is moved across the traffic surface 12. While the forward wheels 16 do not swivel, they are power-driven through the axles 15, 17 to facilitate moving the machine 10 across the traffic surface 12, as will be discussed in greater detail The wheels 16, 18 support the carriage structure 20 so that it extends substantially parallel to the plane of such portions of the traffic surface 12 as underlie and are engaged by the wheels 16, 18. When the traffic surface portions that underlie and support the wheels 16, 18 extend in a substantially horizontal plane, the carriage structure 20 likewise extends substantially horizontally.

An imaginary "center axis" of the machine 10 is depicted in FIGS. 1, 2 and 4 by a centerline, indicated by an arrow 40. In FIG. 3, the machine's center axis is depicted by a dot, indicated by an arrow 40. The center axis 40 extends substantially normal to (i.e. , substantially perpendicular to) the plane of the traffic surface 12. When the plane of the traffic surface 12 is horizontal (i.e., as it is depicted in FIGS. 1, 2 and 4), the center axis 40 extends substantially vertically. However, if the plane of the traffic surface that is supporting the machine 10 does not extend horizontally, it will be understood by those who are skilled in the art that the center axis 40 will be correspondingly inclined from the vertical. Thus, while for purposes of simplification in many portions of this document, the center axis 40 is referred to by such terms as "extending vertically," it will be understood that the center axis 40 actually extends precisely vertically only when such portions of the traffic surface 12 as are engaged by the wheels 16, 18 extend precisely in a common horizontal plane. Likewise, it will be understood that the use herein of such terms as "extending vertically," "extending horizontally" and the like is for purposes of simplifying the description and is not intended to limit the scope of coverage.

The carriage structure 20 includes a welded assembly of lengths of structural steel that have substantially identical channel-shaped cross sections, including right and left side members 22, 23 (FIGS. 1–4) that extend along lower portions of upstanding right and left sidewalls 52, 53 an of a generally rectangular tank assembly 50; front and rear transversely extending members 24, 25 (FIG. 1) that extend along lower portions of upstanding front and rear sidewalls 54, 55 of the tank assembly 50; and front and rear end members 26, 27 (FIGS. 1 and 3) that extend between opposed front and rear end regions, respectively, of the right and left side members 22, 23.

The carriage members 22–27 are arranged such that their upper surfaces all extend in one horizontally extending plane; such that their lower surfaces all extend in another horizontally extending plane; and such that the transversely extending members 24–27 each have one of their ends welded to the upstanding web of the right side member 22, while their other ends are welded to the upstanding web of the left side member 23. By this arrangement, the members 22–27 cooperate to form a simple but rigid, generally rectangular framework; and the members 22–24 extend perimetrically about the upstanding sidewalls 52–54 of the tank 50.

The carriage 20 also includes a bottom beam 28 (FIGS. 1 and 3) that extends forwardly-rearwardly at a location that is substantially centered between the right and left sides of the carriage 20. The bottom beam 28 overlies and is welded to central portions of the top surfaces of each of the transversely extending members 24, 25 and 26. While the carriage members 22–27 preferably all are formed from structural steel that has a common channel-shaped cross-section (preferably a cross-section having a center web that measures about two inches in height), the bottom beam 28 preferably is formed from a significantly heavier piece of structural steel that has a flange height (as viewed in FIG. 1) of about two inches and a central web width (as viewed in FIG. 1) that measures about six inches. By welding the distal edges of the flanges of the bottom beam 28 to the top surfaces of the transversely extending members 24, 25 and 26 at locations that are mid-way along the lengths of the members 24, 25 and 26, the central web of the bottom beam 28 is oriented to define a flat, upwardly facing surface 29 (FIGS. 2–4) that is used to support portions of a bottom wall 51 (FIG. 2) of the tank 50

Referring variously to FIGS. 1–4, the tank 50 is a welded assembly of steel side walls 52–55 and a steel bottom wall 51, with each of the walls 51–55 being of substantially rectangular configuration. The tank 50 is reinforced near its lower end 1) by the aforedescribed channel members 22–25 which extend perimetrically about the bottom of the tank 50, and 2) by the bottom beam 28 that underlies portions of the bottom wall 51 of the tank 50.

In the manner that the channel members 22–25 provide a generally rectangular frame that perimetrically surrounds and reinforces lower portions of the sidewalls 52–55 of the tank 50, a similar set of channel members 32–35 is provided to define a generally rectangular frame that perimetrically surrounds and reinforces upper portions of the tank sidewalls 52–55. And, in a similar manner, a set of channel members 42–45 (that is identical to the set of channel members 32–35) is provided to form a generally rectangular frame that perimetrically surrounds middle portions of the sidewalls 52–54 of the tank 50. In preferred practice, each of the channel members 22–27, 32–35 and 42–45 is formed from structural steel that has a common channel-shaped cross section.

Referring to FIGS. 1 and 3, in the same manner that the bottom beam 28 1) underlies (and is welded to) the bottom wall 51 of the tank 50 and 2) extends across (and is welded to) top surfaces of the channel members 24–26, a top beam 38 is provided that 1) overlies the tank 50 and 2) extends across (and is welded to) top surfaces of the channel members 34 and 35.

Right and left door panels 62, 63 are pivotally connected to the top beam 38 by "continuous hinge" assemblies 64, 65 that extend along (and are welded to) opposite upstanding flanges of the top beam 38. Right and left handles 66, 67 are provided to facilitate pivoting the door panels 62, 63 between the closed positions that are depicted in the drawings and open positions (not shown) that permit fluid coating constituents to be poured into the reservoir 70 that is defined by the tank 50.

While the tank assembly 50 is described and depicted herein as defining only a single reservoir chamber 70 (FIG. 3) for receiving fluid coating constituents (not shown) that are to be dispensed onto the traffic surface 12, it is possible for the tank assembly 50 to be constructed so as to provide a plurality of compartments or reservoirs (not shown—but discussed in a number of the referenced Parent Patents, e.g. , in the referenced Fourth Parent Case) for containing and dispensing segregated quantities of coating constituents.

Referring to FIG. 2, a centrally located outlet opening 80 is defined in the bottom of the tank 50. The outlet opening 80 is defined by an upper end region 81 of a tubular stub shaft member 82 that projects through a centrally located hole 85 that is formed in the bottom wall 51. The tubular stub shaft member 82 extends coaxially about the center axis 40 and has a lower end region 83 that is located several inches below the bottom wall 51 of the tank 50. A discharge opening 90 is defined by the lower end region 83 of the tubular stub shaft member 82.

Surrounding the upper end region 81 of the tubular stub shaft member 82 is a relatively thick reinforcing sleeve 84. The sleeve 84 has its upper end extending into underlying engagement with the bottom surface of the bottom wall 51 of the tank 50 to securely support the bottom wall 51 in the vicinity of the outlet opening 80. The sleeve 83 is welded to the upper end region 81 of the tubular stub shaft member 82, to the bottom wall 51 of the tank 50, and to the bottom beam 28, and thereby reinforces the junctures of these components within the vicinity of the outlet opening 80.

Referring still to FIG. 2, a tapered, stopper-like valve member 86 is provided for controlling the flow of coating constituents from the reservoir 70 through the outlet opening 80 and through the tubular stub shaft member 82 for downward discharge onto the traffic surface 12 through the discharge opening 90. A control rod 87 carries the valve member 86 and extends upwardly through the tank 50 along the center axis 40. Spaced above the outlet opening 80 is a guide-like support member 88 that assists in keeping the control rod 87 aligned along the center axis 40. The support member 88 includes a sleeve 89 through which portions of the control rod 87 loosely extend, and elongate body portions 91 that rigidly connect with the front and rear walls 54, 55 of the tank 50.

The control rod 87 has an upper end region 92 that carries a coarse set of threads 93. Welded to the top beam 38 is a threaded sleeve 94 through which the upper end region 92 of the control rod 87 is threaded. Welded to the upper end of the control rod 87 is a toothed sprocket 95 (FIGS. 1–3) which, when rotated in clockwise and counterclockwise directions about the center axis 40 serves to thread the control rod 87 through the threaded sleeve 94 to raise and lower the valve member 86 relative to the outlet opening 80. When in its lowermost position (not shown), the valve member 86 sealingly engages such upper end region portions of the tubular stub shaft 82 as define the outlet opening 80—much in the same manner that a tapered sink stopper wedgingly closes the upwardly facing drain opening of a sink. The extent to which the valve member 86 is raised above the outlet opening 80 serves to regulate the rate at which fluid coating constituents discharge from the reservoir 70 through the outlet opening 80 and thence through the discharge opening 90 onto portions of the traffic surface 12 that underlie the machine 10.

To control the position of the valve member 86 relative to the outlet opening 80, a roller chain 96 is reeved around the sprocket 95 and around a second sprocket 97 that is supported on a stub shaft 98 that is connected to the front end region of the top beam 38. An operator control in the form of a crank handle 99 is connected to the second sprocket 97 for rotation therewith about the axis of the stub shaft 98. By rotating the crank handle 99 selectively clockwise and counterclockwise, the chain-interconnected sprockets 95, 97 cause the control rod 87 to selectively raise and lower the valve member 86 between positions that permit a desirably regulated flow of fluid coating constituents to discharge through the discharge opening 90, and a position wherein the valve member 86 closes the outlet opening 80 to stop the discharge of fluid coating constituents from the discharge opening 90.

Referring to FIGS. 2 and 3, a blender shaft 100 extends substantially centrally through the tank 50 from side to side thereof. Right and left end regions 102, 103 of the blender shaft 100 extend through aligned holes that are formed centrally through the right and left side walls 52, 53 and through the right and left frame members 42, 43, respectively. Right and left lubricated bearing units 112, 113 are connected to the right and left side walls 52, 53 and extend for short distances into the reservoir 70 that is defined by the tank 50. The bearing units 112, 113 journal the left and right end regions 102, 103 of the blender shaft 100 and cooperate with the shaft 100 to define an axis of blender shaft rotation that is indicated in FIG. 3 by the arrow 110.

Referring to FIGS. 1 and 2, a relatively large diameter V-belt pulley 120 is connected to the right end region 102 of the blender shaft 100 for rotating the blender shaft 100 preferably at a rate of rotation that is between about 30 to about 60 revolutions per minute. A V-belt 125 is reeved around the relatively large pulley 120 and around a relatively small pulley 130 that is located relatively near the right front corner of the carriage 20. A belt tensioner pulley 135 engages the periphery of the belt 125 for purposes of loosening and tightening the grip of the belt 125 on the pulleys 120, 130 so as to selectively establish a driving connection therebetween.

Referring to FIG. 2, a position of the tensioner pulley 135 that tensions the belt 125 adequately to establish a driving connection between the pulleys 120, 130 is shown in solid lines, while a position of the tensioner pulley 135 that releases belt tension adequately to provide no driving connection between the pulleys 120, 130 is shown in dotted lines, with corresponding positions of a control lever 145 that positions the tensioner pulley 135 also being shown in solid and in dotted lines. The control lever 145 is pivotally connected to a stub shaft 146 that is welded to the front wall 54 of the tank 50, and has an arm 147 that projects from the vicinity of the stub shaft 146 to support the tensioner pulley 135. A spring detent 148 carried by the lever 145 is engageable with a series of holes 149 formed in a curved bracket 150 that projects forwardly from the front wall 54 of the tank 50 to releasably retain the control lever 145 in its belt-tensioning position (shown in solid lines in FIG. 2) and its non-tensioning position (shown in dotted lines in FIG. 2). In preferred practice, a safety enclosure type of guard loosely surrounds the belt 125 and the pulleys 120, 130, 135 to prevent persons and objects from inadvertently coming into engagement with these drive connection components. Portions of such a guard-type enclosure are indicated by the numeral 155 in each of FIGS. 1–4.

Referring to FIG. 3, two hubs 160 are mounted on the blender shaft 100 at spaced locations within the tank 50. Blender blades 165 are carried by the hubs 160. Rigid driving connections are established by the hubs 160 between the blender shaft 100 and the blender blades 165 so that, when the blender shaft 100 is rotated about its axis 110, the blender blades 165 are caused to rotate within the tank 50 to cause stirring, mixing and blending of such fluid constituent coating components as are contained within the reservoir 70 that is defined by the tank 50.

Referring to FIGS. 1, 2 and 4, a generally U-shaped handle 170 extends forwardly from the channel member 34 that extends along top portions of the front wall 54 of the tank 50. In preferred practice, the handle 170 is formed as a welded assembly from three pieces of structural steel or steel pipe. The purpose of the handle 170 is to provide a strong, easy-to-grasp structure that will enable an operator to physically guide the movement of the machine 10.

Referring to FIGS. 1-3, a trailing type of resilient finishing blade assembly 180 is mounted at the rear of the carriage 20 for depending toward and into gentle engagement with such traffic surface portions as have been coated during passage thereover of other operational components of the machine 10. A purpose served by the resilient finishing blade assembly 180 is to assist in assuring that a newly applied coating is smooth and uniform—and to minimize the possibility that wheel tracks are left in the newly applied coating.

The resilient finishing blade assembly 180 is adjustably connected to the carriage 20 by means of right and left mounting assemblies 184 that are identical except for the fact that one connects with the rear end of the left carriage channel 22 while the other connects with the rear end of the right carriage channel 22. Since the mounting assemblies 184 are identical, only one will be described.

Referring to FIG. 2 wherein features of one of the mounting assemblies 184 is best depicted, a support bracket 185 has an internally threaded, substantially vertically extending hole 186 formed therethrough. An externally threaded tubular adjustment sleeve 187 is threaded into the hole 186 and has a hex formation 188 near its upper end for permitting a wrench (not shown) to be utilized to thread the sleeve 187 upwardly or downwardly through the hole 186 as may be desired to selectively adjust the vertical position of the tubular sleeve 187. A support rod 189 extends vertically through the tubular sleeve 187. A yoke formation 190 is defined at the lower end of the support rod 189 for receiving an upper edge portion of the resilient member 182. A fastener 191 extends through aligned holes that are formed through the yoke formation 190 and through upper edge portions of the resilient member 182 to securely connect the support rod 189 to the resilient member 182. The upper end of the support rod 189 is threaded carries at least one lock nut 192 thereon. A compression coil spring 193 is interposed between the lower end of the tubular sleeve 187 and the yoke formation 190 to bias the resilient member 182 downwardly toward engagement with the traffic surface 12.

The mounting assemblies 184 are adjustable both to vertically position the resilient member 182 and to set a permitted range of travel through which the resilient member 182 can move vertically. By treading the sleeve 187 upwardly or downwardly relative to its associated support bracket 185, and by selectively positioning the lock nut 192 on the support rod 189, these adjustments are effected. In preferred practice, the bottom edge of the resilient member 182 preferably is positioned to gently engage the traffic surface 12, and a small but reasonable range of vertical travel is set through which the resilient member 182 is permitted to move to accommodate variations that may be encountered in the traffic surface 12.

Disposed beneath the carriage assembly 20 and extending in a radially arranged array relative to the center axis 40 is a set of rotary finishing tools 200 that is power driven to rotate about the center axis 40 to mix, spread and apply coating constituents that are deposited on the traffic surface 12. Referring principally to FIG. 2 (but also with occasional reference to FIG. 4), the rotary tool unit 200 includes a rotary member 210 that is rotatably connected by bearings 212 to the hollow, depending stub shaft 82 through which at least a fluid portion of such coating constituents as are to be applied to the traffic surface 12 are dispensed. The rotary member 210 is a four-sided block of steel that defines four upstanding outer faces 211 that are arranged in opposed pairs, with the faces of each pair extending parallel to each other, and with the faces of the two pairs extending substantially perpendicular to each other. Faces of one of the pairs are designated by the numeral 211' in FIG. 2. Faces of the other pair are designated by the numeral 211" in FIG. 4.

Referring to FIG. 2, internal features of the rotary member 210 include a centrally-extending passage through 216 that extends along the center axis 40. The passage 216 is enlarged near its upper and lower end regions to receive the bearings 212. A snap ring 218 engages a circumferentially extending groove that is formed toward the bottom end region of the stub shaft 82 to hold a washer 222 in place above the snap ring 218. The washer 222 engages the bottom bearing 212 and assists in retaining the rotary member 210 in place on the stub shaft 82. A sleeve-like spacer 224 is provided atop the upper bearing 212 and extends into engagement with the bottom of the reinforcing sleeve 84 that forms a part of the welded assemblage of the carriage structure 20 and tank assembly 50, described above.

A pulley 300 is bolted to the upper end region of the rotary member 210 and, when driven by means of a belt 310 that is reeved around the pulley 300, serves to rotate the rotary member 210 about the center axis 40 preferably within the range of about 40 to about 70 rpm.

The four-sided block of steel that forms the rotary member 210 carries four identical yoke-like formations 230 (two of which are shown in FIG. 2, with the remaining two being shown only partially in FIG. 4). The yoke-like formations 230 extend radially outwardly relative to the center axis 40, with each of the formations 230 extending substantially perpendicular to its two nearest neighbor formations 230. Inner end regions 242 of four tubular arms 240 (two of which are shown in FIG. 2, with the remaining two being shown in FIG. 4) are received within the yoke-like formations 230, and are pivotally connected thereto by pivot pins 244 (two of which are shown in FIG. 2) that extend substantially horizontally through aligned holes formed in the yoke formations 230 and in the inner end regions 242 of their associated tubular arms 240.

Four blade-like applicator tools 250 (two of which are depicted in FIG. 2, with the remaining two being depicted in FIG. 4) are positioned beneath outer end regions 248 of the tubular arms 240 The applicator tools 250 can take any of a variety of forms, but preferably take the forms that are described in detail in the referenced Parent Patents, whereby many of the tools 250 each has a resilient, blade-like bottom portion 252 that extends upwardly and connects with a rigid support 254 that is pivotally connected to a separate one of outer end regions 248 of the arms 240. In preferred practice, yoke-like structures 256 are defined by the supports 254 to extend along opposed sides of the outer end regions 248, and pivot pins 260 (two of which are shown in FIG. 2) extend through aligned holes that are formed through the outer end regions 248 and through the yoke-like structures 256 to pivotally connect the applicator tools 250 to the radially extending arms 240.

While the arms 240 extend substantially radially with respect to the center axis 40, the blade-like applicator tools 250 preferably are canted or inclined relative to the arms 240 so that outer end regions of the blades 250 tend to lead inner end regions when the rotary tool unit 200 is rotated about the axis 40 in a forward direction of rotation which is indicated in FIGS. 1 and 3 by arrows 190. Moreover, the pivot pins 260 that pivotally connect the blade-like applicator tools 250 to the tubular arms 240 preferably are inclined slightly relative to the horizontal, typically by only about five degrees, so that upper portions of the blade-like applicator tools 250 tend to slightly lead lower portions of the tools 250 when the rotary tool unit 200 is rotated in the direction of the arrows 190. These slight inclinations or incantations of the applicator tools assist in minimizing tool "chatter" and "drag," help to maintain proper control of such coating constituents as are being mixed, spread and applied to the traffic surface 12, and tend to assist in assuring that coating constituents are mixed properly and are applied smoothly.

As can be seen in FIGS. 1 and 4, outer end regions 251 of the blade-like applicator tools 250 extend beyond the width the carriage 20 (it being understood that the "width of the carriage 20" is defined by the distance between the outermost surfaces of the side channels 22, 23) as they rotate about the center axis 40 (e.g., in FIG. 3, curved, dotted lines designated by the numeral 290 depict the rotary path of the outer end regions 251 of the blade-like applicator tools 250). To provide for operator safety, arcuate, skirt-like guards preferably are provided to protectively enclose the outer end regions 251 to the extent that they project beyond the width of the carriage 20 during rotation about the center axis 40. In FIG. 1, a portion of one such skirt-like guard is indicated generally by the numeral 292.

The forward end portion of the carriage 20 is provided with an elevated motor-mount platform that is indicated in each of FIGS. 1–4 by the numeral 294. The platform 294 includes a flat metal plate 295 of generally rectangular configuration that is rigidly secured (typically by welding) to the upper face 29 of the bottom beam 28, and to various lengths of channel members 296 that are rigidly secured (typically by welding) atop portions of one or more of the carriage channels 22, 24, 26.

Located beneath the flat metal plate 295 are a number of drive components that cooperate to distribute rotary energy that is supplied by a depending output shaft 330 of an engine 320 (or other source of rotary energy such as an electrically powered motor, not shown). The engine 320 typically is about a 3 ½ horsepower internal combustion engine that has an output shaft speed of up to about 3600 revolutions per minute, and is rigidly secured to the flat metal plate 295 (typically by means of removable fasteners, not shown) such that its output shaft 330 depends substantially vertically through a hole 331 (FIG. 4) that is formed through the plate 295.

So that the engine 320 can be started in a "no load" condition, and so that the operation of the engine 320 can be smoothly and successfully brought up to a reasonable operating speed before any load is applied to the output shaft 330, a centrifugal clutch 340 (see FIG. 3) is connected to the output shaft 330. The centrifugal clutch 340 is a commercially purchased assembly that has its mechanism housed in a generally cylindrical enclosure bordered circumferentially by a V-belt pulley 350 that is drivingly connected to the output shaft 330 of the engine 320 only when the rotation of the output shaft 330 has been brought up to a reasonable speed, typically about 2200 revolutions per minute.

Continuing to refer principally to FIG. 3, a V-belt 355 is reeved around the pulley 350 of the centrifugal clutch 340 and around a pulley 360 that inputs rotary energy to a right angle speed reducer 370. A jackshaft 375 extends through the hollow output connection (not shown) of the speed reducer 370. A pair of bearings 377 journal the jackshaft 375 at locations spaced from the speed reducer 370 and on opposite sides thereof. The bearings 377 are connected by suitable mounting brackets (not shown) to components of the welded carriage structure 20.

Near the left end region of the jackshaft 375 (i.e., the right end region as viewed in FIGS. 3 and 4), a mechanically engageable/disengageable clutch 390 is provided for selectively drivingly connecting the jackshaft 375 to a clutch-carried sprocket 392. A roller chain 394 is reeved around the sprocket 392 and around the input sprocket 396 of the differential 19. The differential 19 functions to transmit rotary energy to the front axles 15, 17 and thence to the front wheels 16 to move the machine 10 along a preselected path of travel at a forward velocity that preferably is within the range of about 1.5 to about 3.0 miles per hour. Referring to FIGS. 1 and 4, a control lever 395 is connected by suitable linkage 397 to the mechanical clutch 390 to permit the clutch 390 to be selectively engaged and disengaged to selectively transmit rotary energy from the engine-driven jackshaft 375 to the front wheel 16.

The right end region of the jackshaft 375 (i.e., the left end region as viewed in FIGS. 3 and 4) is drivingly connected to the V-belt pulley 130 that drives the belt 125. The belt 125 selectively rotates the blender shaft 100, depending on whether the lever 145 is positioned to tension or to release tension in the belt 130, as has been described.

Near the right end region of the jackshaft 375 (i.e., near the left end region as viewed in FIGS. 3 and 4), a sprocket 400 is drivingly connected to the jackshaft 375. A roller chain 405 is reeved around the sprocket 400 and around a sprocket 410 that forms a part of a mechanically operated clutch 420. As is best seen in FIG. 3, the clutch 420 is positioned beside and is drivingly connected to input rotary energy to a right angle gearbox 425. The gearbox 425 has a vertically extending output shaft 430 that is drivingly connected to a V-belt pulley 440. The V-belt 310 (that previously has been described as being reeved around the pulley 300 that rotates the set of rotary tools 200 about the center axis 40) also is reeved about the pulley 440 and is constantly held taut by means of a spring-biased idler assembly 450. The idler assembly 450 is connected to the carriage 20 at a location beneath the tank 50 and serves to constantly maintain proper tension in the belt 310 to enable the pulley 440 to drive the pulley 300. A control lever 475 is provided with suitable linkage 477 for connecting with and operating the clutch 420 to selectively drivingly connect the engine-driven jackshaft 375 with the gearbox 425 for selectively rotating the rotary tools 200.

Referring to FIGS. 1, 2 and 4, the engine 320 is provided with a throttle lever 322 to enable the speed of its output shaft 330 to be adjusted. In preferred practice, the normal operating range of the engine is preferably held within a range of about 2200 to about 3600 revolutions per minute. With the engine 320 operating within the range of about 2200 to about 3600 rpm, the drive linkage that connects with the front axles 15, 17, with the blender shaft 100, and with the V-belt pulley 300 that rotates the rotary tools 200 preferably is designed to serve the functions 1) of moving the machine 10 along a forward path of travel at a forward velocity of between about 1.7 to about 2.7 miles per hour, 2) of rotating the blender blades 165 at between about 34 and about 53 revolutions per minute, and 3) of rotating the set of tools 200 at between about 42 and about 66 revolutions per minute.

At an engine speed just slightly higher than 2200 rpm, the drive wheels 16 begin to move the machine 10 at about 1.7 mph; and, assuming that the two mechanical clutches 390, 420 are engaged, the set of rotary tools 200 begins rotating at about 42.5 rpm while the blender shaft 100 begins rotating at about 34 rpm. At a more "normal" engine speed of about 2700–2800 rpm, the forward velocity of the machine 10 is preferably within the range of about 2.1 to about 2.2 mph; the rotary tools 200 turn at about 52 to about 53 rpm;, and, the blender shaft 100 rotates at about 42–43 rpm. At a maximum engine speed of about 3300 to about 3400 rpm, the forward velocity of the machine 10 is preferably within the range of about 2.6 to about 2.7 mph; the tool rotation speed is preferably within the range of about 65–66 rpm; and the blender shaft rotation speed is preferably within the range of about 52–53 rpm.

By coordinating the forward velocity of the machine 10 with the speed of rotation of the tools 200, and by simultaneously maintaining a regulated rate of discharge of fluid coating constituents that, taken together, will result in the fluid coating constituents being applied such that about a gallon covers about 45 to about 55 square feet, consistently good uniformity of the applied coating should result. Likewise, by suitably coordinating the speed of rotation of the blender blades 165 with the speed of rotation of the tools 200 and with the forward velocity of the machine 10, achieving a uniform discharge rate of homogeneously mixed fluid constituents from the reservoir 70 is facilitated.

In preferred practice, maintaining the forward velocity of the machine within the range of about 1.7 to about 2.7 miles per hour while maintaining the speed of rotation of the rotary tools 200 within the range of about 42 to about 66 revolutions per minute while also maintaining a substantially constant ration of about 1 to 25 between the velocity in miles per hour of the machine 10 and the rotational speed in revolutions per minute of the rotary tools 200 will help to maintain uniformity of application of the resulting coating. Furthermore, by maintaining the rotational speed in revolutions per minute of the blender blades 165 between about 34 to about 53, while assuring that the rate of discharge of fluid coating constituents provides for the spreading of a gallon of fluid coating constituents over about 45 to about 55 square feet of traffic surface will likewise help to maintain uniformity of application of the resulting coating.

The description presented thus far is of a coating apparatus 10 that is, in essence, self-powered and self-propelled, and that requires no attachment to any form of additional wheeled vehicle in order to carry out its intended function. In essence, what has been described thus far is the same coating apparatus 10 that is described in the referenced Fifth Parent Case, U.S. Pat. No. 5,251,998 .

In its simplest form, the present invention provides a coating apparatus of the general type that is disclosed in the referenced Fifth Parent Case that is adapted to be "vehicle-connected" so as to utilize features and capabilities of the vehicle to which it is connected to power and/or guide and move the coating apparatus. The type of wheeled vehicle to which the coating apparatus is connected preferably is a tractor or truck, but may also take the form of a wagon or other known forms of commercially available wheeled vehicles.

To effect one simple form of vehicle connection, the apparatus 10 is depicted in FIGS. 1–4 as differing from the apparatus 10 that is disclosed in the referenced Fifth Parent Case only in that a vehicle-connectable hitch 500 is connected to the right and left side members 22 23 of the carriage 20. The hitch 500 (best seen in FIG. 1) has right and left side members 522, 523 that are configured to extend closely alongside extended forward end regions of the right and left side members 22, 23, respectively. The hitch 500 also has a transversely extending front member 524 that interconnects the side members 522, 523. A forwardly-extending, centrally-located formation 525 is rigidly connected to the front member 524 for receiving a hitch pin 550 (see FIG. 5). A shaft 510 is provided for extending through aligned holes (not shown) that are formed in the right and left side members 22, 23 and 522, 523 to pivotally connect the hitch 500 to the carriage 20 so that the hitch 500 can pivot relative to the carriage 20 about the axis of the shaft 510.

Figure 5:
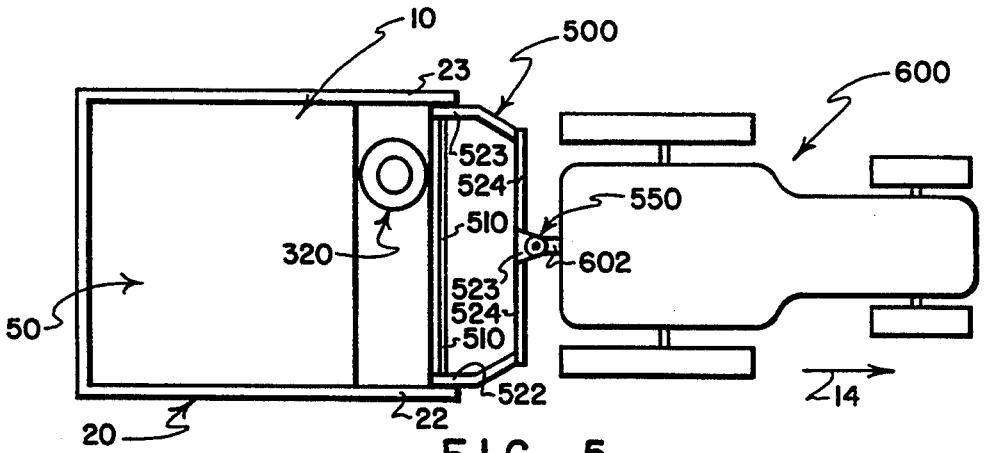
FIG. 5 is a schematic top plan view of the coating apparatus of FIGS. 1–4 shown connected to a hitch of a wheeled vehicle, namely a tractor.

Referring to FIG. 5 (wherein the apparatus 10 is depicted somewhat schematically), a hitch pin 550 is provided for connecting the forwardly-extending portion 525 to a hitch 602 of a tractor 600. With the coating apparatus 10 "hitch-connected" to the tractor 600 by the hitch pin 550, the coating apparatus can be guided and moved by the tractor 600. When the coating apparatus 10 is being moved by the tractor 600, the clutch control lever 397 (see FIG. 1) is set to disengage the front wheels 16 from being driven by the engine 320 (and/or other suitable steps are taken to ensure that the front wheels 16 are drivingly disconnected from the engine 320) to thereby permit the front wheels 16 of the apparatus 10 to rotate freely as the apparatus 10 is guided and moved by the tractor 600.

In FIGS. 6 through 9, modified forms of the apparatus 10 are indicated by numerals 1010, 2010, 3010 and 4010, respectively. Inasmuch as the modified forms of apparatus 1010, 2010, 3010, 4010 are, in most ways, substantially the same as the above-described apparatus 10, several of the reference numerals that appear in FIGS. 6–9 correspond to those that are used in FIGS. 1–5 except that these reference numerals have values added thereto of 1000, 2000, 3000 and 4000, respectively.

Because "corresponding" reference numerals are used in FIGS. 6–9 that designate already-described "corresponding" components that are depicted in one or more of FIGS. 1–5, it is not necessary to repetitively describe what is indicated by some of the reference numerals that are utilized in FIGS. 6–9. While text may not be present to so state, such reference numerals as 1022, 2022, 3022 and 4022 that are found in FIGS. 6, 7, 8 and 9, respectively, will be understood to designate the same sort of frame component as is designated by the reference numeral 22 in FIGS. 1–5. Likewise, the numerals 2550 and 4550 that appear in FIGS. 7 and 9 will be understood to designate hitch pins, just as does reference numeral 550 that appears in FIG. 5.

Figure 6:
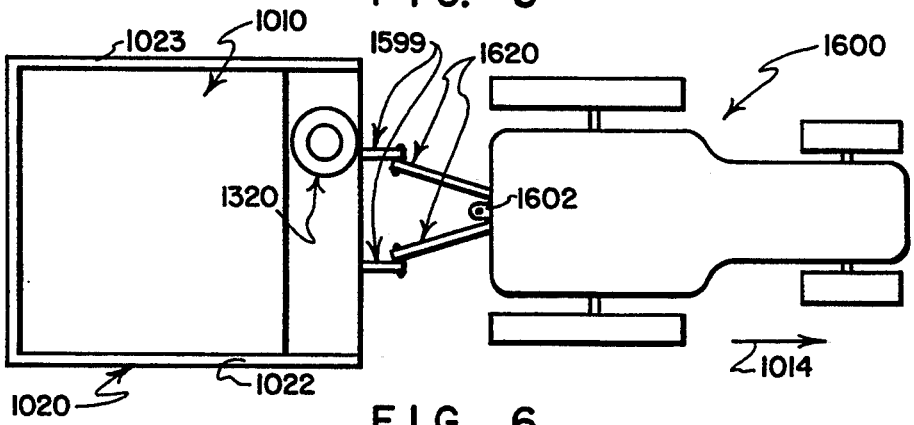
FIG. 6 is a schematic top plan view similar to FIG. 5 but showing the coating apparatus connected to a pair of vehicle-carried support arms, typically the two lower arms of a conventional "three point hitch" of a tractor.

In FIG. 6, a coating apparatus 1010 is shown that is identical to the coating apparatus 10 in all respects except that 1) the hitch 500 has been replaced by a pair of forwardly-extending support bars 1599 that are rigidly connected to the carriage 1020 of the coating apparatus 1010, and 2) the apparatus 1010 has no front wheels of the type that are indicated by the numeral 16 in FIGS. 1–4. The forwardly-extending support bars 1599 are releasably connected to a pair of rearwardly-extending support arms 1620 of a tractor 1600. In preferred practice, the rearwardly-extending support arms 1620 constitute the two lower arms of what is commonly known as a "3-point hitch" —a "hitch" that commonly is provided on the rear of farm tractors and the like, and that can function (when the arms 1620 are pin-connected to the support bars 1599) not only to guide and move the coating apparatus 1010 but also to "vehicle-support" front end portions of the apparatus 1010 from the tractor 1600.

As will be readily apparent to those who are skilled in the art, while the vehicle-connected coating apparatus 10 that is depicted in FIG. 5 can be guided and moved by the tractor 600, the vehicle-connected coating apparatus 1010 that is depicted in FIG. 6 is not only guided and moved by the tractor 1600, but also has front portions of its carriage 1020 supported by virtue of the apparatus-to-vehicle connection that is made between the support bars 1599 and the arms 1620.

Figure 7:
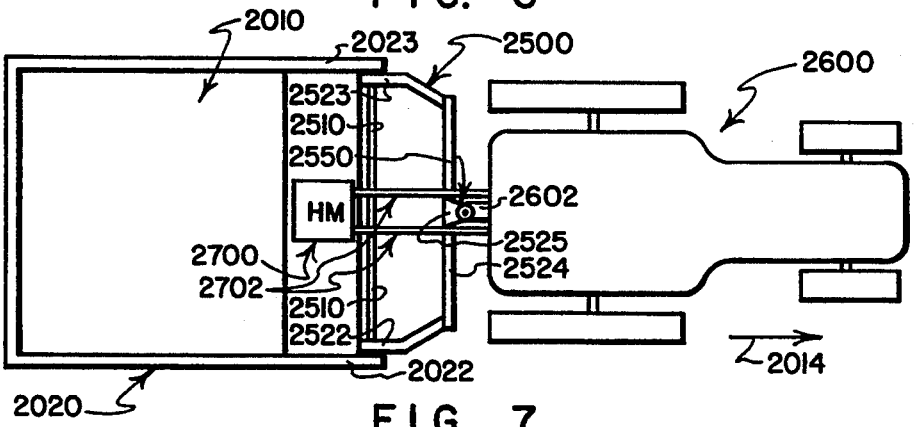
FIG. 7 is a schematic top plan view similar to FIG. 5 but showing the coating apparatus hitch-connected to a tractor, with the engine of the coating apparatus having been replaced by a hydraulic motor, and showing a pair of hydraulic lines interconnecting the hydraulic motor with a hydraulic system of the tractor.

In FIG. 7, a coating apparatus 2010 is shown that is identical to the coating apparatus 10 in all respects except that a commercially available hydraulic motor 2700 is substituted (for the engine 320 that is used by the apparatus 10) to drive such corresponding components of the coating apparatus 2010 as are driven by the engine 320 on the apparatus 10. A pair of hydraulic lines 2702 extend from the hydraulic motor 2700 for connection at the rear of the tractor 2600 with a conventional hydraulic system (not shown) of the tractor 2600 that is utilized to operate the hydraulic motor 2700 at a suitable speed of rotation for driving the various relatively movable components of the coating apparatus 2010. Thus, an example is provided of one of the ways in which a source of energy of a vehicle to which a coating apparatus is connected can be utilized for the purpose of operating selected components of the coating apparatus.

Figure 8:
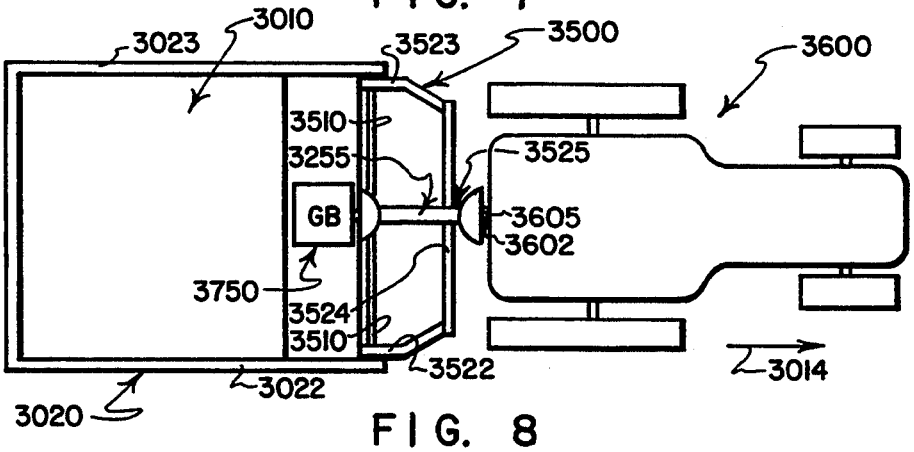
FIG. 8 is a schematic top plan view similar to FIG. 5 but showing the coating apparatus hitch-connected to a tractor, with the engine of the coating apparatus having been replaced by a gear box that is connected by a conventional telescopically extensible, tube-shielded universal joint shaft to a power take off (PTO) drive of the tractor.

In FIG. 8, a coating apparatus 3010 is shown that is identical to the coating apparatus 10 in all respects except that a commercially available gearbox 3750 is substituted (for the engine 320 that is used by the apparatus 10) to drive such corresponding components of the coating apparatus 3010 as are driven by the engine 320 on the apparatus 10. A conventional, tube-guarded, telescopically extensible universal shaft assembly 3755 establishes a driving connection between a "power take off" (PTO) shaft 3605 of the tractor 3600 and the gearbox 3750 so that the conventional PTO drive of the tractor 3600 can be utilized to operate the various relatively movable components of the coating apparatus 3010. Thus, another example is provided of one of the ways in which a source of energy of a vehicle to which a coating apparatus is connected can be utilized for the purpose of operating selected components of the coating apparatus.

Figure 9:
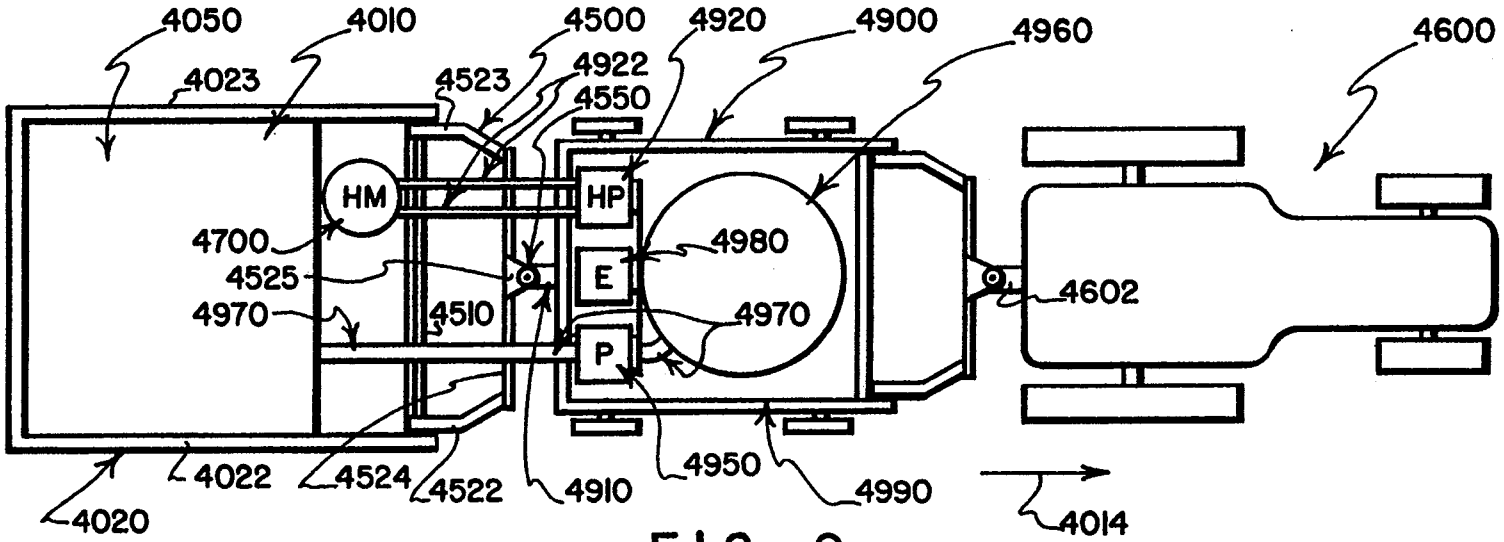
FIG. 9 is a schematic top plan view similar to FIG. 5 but depicting the use of a wheeled vehicle such as a tractor-towed wagon to support a number of components of the coating apparatus including an engine, an engine-driven pump for delivering coating constituents from a wagon-carried tank to the main reservoir of the coating apparatus, and showing an engine-driven, wagon-carried hydraulic pump that is connected by hydraulic hoses to a hydraulic motor that is utilized to operate other components of the coating apparatus; and, FIG. 10 is a schematic top plan view of a coating apparatus together with bed and cab and cab portions of a wheeled vehicle such as a truck, with the apparatus including a side-by-side tandem array of sets of rotary tools of the general type that are used in the coating apparatus of FIGS. 1–4, but with many of the other components of the coating apparatus (including a reservoir for containing a supply of coating constituents) being situated atop the bed of the truck so as to be "vehicle-carried," and with hydraulic motors being utilized to rotate the sets of rotary tools and to operate selected vehicle-carried components of the coating apparatus.

In FIG. 9, a coating apparatus 4010 is shown that is identical to the coating apparatus 10 in all respects except that: 1) a commercially available hydraulic motor 4700 is substituted (for the engine 320 that is used by the apparatus 10) to drive such corresponding components of the coating apparatus 4010 as are driven by the engine 320 on the apparatus 10; 2) the hitch 4500 of the apparatus 4010 is connected to a hitch 4910 that is provided at the rear of a wheeled vehicle that takes the form of a tractor-towed wagon 4900; 3) a wagon-carried hydraulic pump 4920 is connected by a pair of hydraulic lines 4922 to the hydraulic motor 4700 operate the hydraulic motor 4700; 4) the reservoir tank 4050 of the coating apparatus of 4010 is supplementally filled by means of a wagon-carried pump 4950 that ducts coating constituents from a wagon-carried mixing tank 4960 through a supply hose 4970; and 5) a wagon-carried engine 4980 is drivingly connected to the hydraulic pump 4920 and to the pump 4950 to operate the pumps 4920, 4950.

What the arrangement of FIG. 9 illustrates is 1) that external power supplied to a coating apparatus from a vehicle to which the coating apparatus is connected need not derive its energy from operation of the same energy source as is utilized to move the vehicle; 2) that components of a reservoir-and-dispensing system of a vehicle-connected coating apparatus can be apparatus-supported and/or vehicle-supported; and 3) that the source of rotary energy (in this case the combination of the hydraulic pump 4920 and the hydraulic motor 4700) that is used to operate components of the coating apparatus also can be partially apparatus-supported and/or partially vehicle-supported.

Referring still to FIG. 9, the reference numeral 4990 is used to designate a pallet-like base atop which the hydraulic pump 4920, the pump 4950, the mixing tank 4960 and the engine 4980 are mounted. By mounting these wagon-carried components on the pallet-like base 4990, the entire set of base-mounted, wagon-carried components can be hoisted (by suitable crane or lift truck, not shown) into and out of the wagon 4900 for selective use and storage, and/or to permit the base-mounted components to be placed on the bed of a truck or other suitable form of wheeled vehicle to which the hitch 4500 of the apparatus 4010 can be connected.

Figure 10:
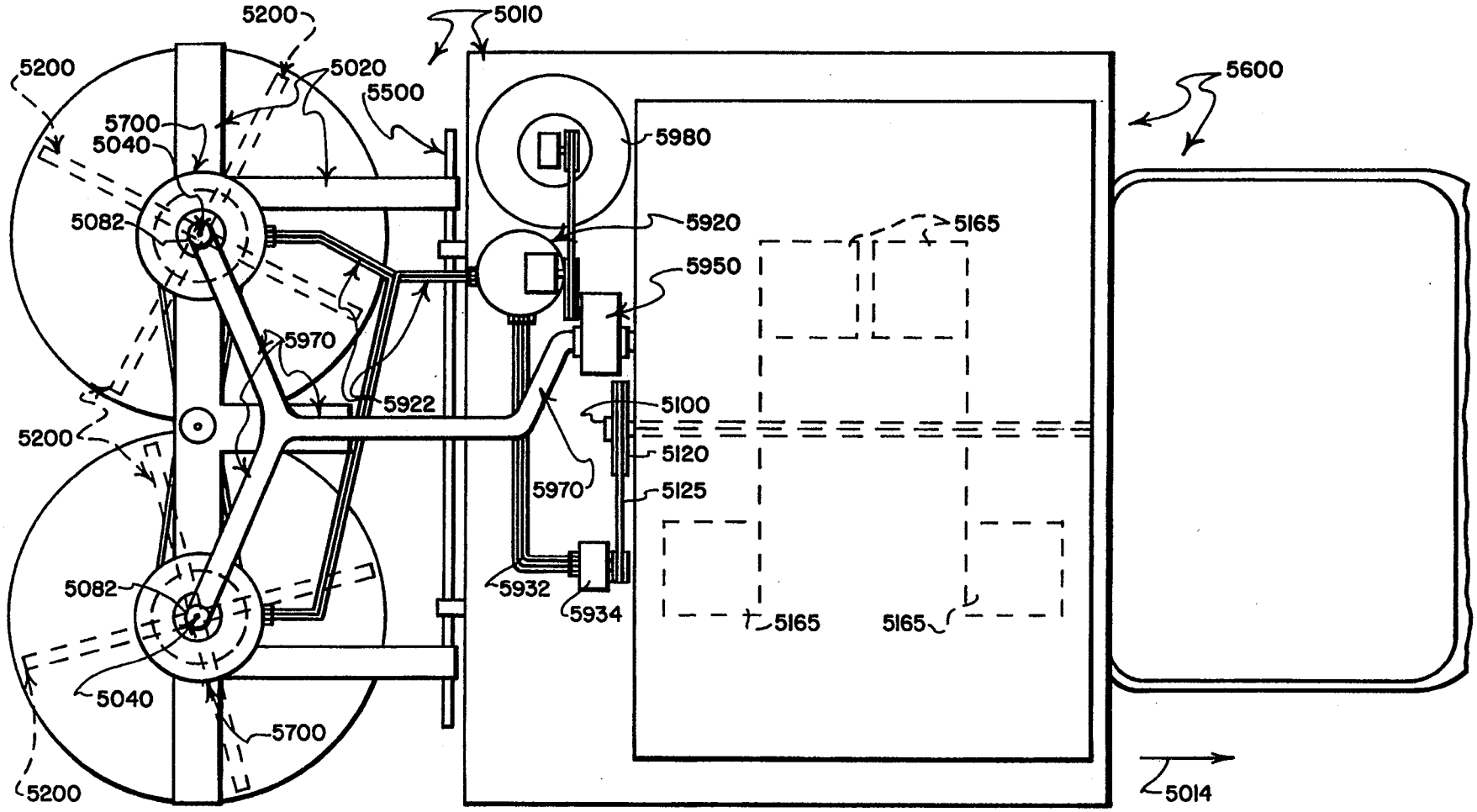

While the coating apparatus 1010, 2010, 3010, 4010 differs relatively little from the coating apparatus 10—except for the substitution of one form of drive for another, the removal to a connected vehicle of one or more component parts, the connection thereto of hoses, and/or the utilization of carriage support provided by a connected vehicle in substitution wheel-supports for the carriage of the coating apparatus—it is possible to make substantially more significant modifications (in an effort to use to greater advantage features and capabilities of a particular vehicle to which a coating apparatus is to be connected) while still remaining within the scope and spirit of the present invention, as is exemplified by the vehicle-connected coating apparatus 5010 that is schematically depicted in FIG. 10.

Referring to FIG. 10, the coating apparatus 5010 has a simplified form of carriage or main frame 5020 that is not only "connected to" a wheeled vehicle, namely a truck 5600, but that also is wholly supported by the truck 5600. The coating apparatus 5010 employs two sets of carriage-connected rotary tools 5200 that rotate about spaced, vertically extending axes 5040, that are driven by hydraulic motors 5700, that have center-fed dispensing conduits 5082 to and through which coating constituents are fed by a hose assembly 5970 so that coating material is "center fed" along the axes 5040 for discharge centrally amount the sets of rotary tools 5200 just as has been described in greater detail in conjunction with the center-fed dispensing conduit 82 of the coating apparatus 10.

Whereas the apparatus 10 utilizes a blender-containing reservoir tank 150 that is "carriage-connected" or "carriage-carried," the apparatus 5010 utilizes a blender-containing reservoir tank 5150 that is "vehicle-connected" or "vehicle-carried." The tanks 150 and 5150 are substantially identical with the exception that, instead of being fitted with a downwardly opening discharge port in the manner of the tank 150, the tank 5150 has a discharge port that communicates with the hose assembly 5970. An engine-driven, vehicle-carried pump 5950 is interposed between portions of the hose assembly 5970 at a location near the tank 5150 to assist in withdrawing coating constituents from the tank 5150 and for delivering coating constituents through the hose assembly 5970 to and through the center-fed dispensing conduits 5082.

An engine-driven, vehicle-carried hydraulic pump 5920 circulates pressurized fluid 1) through hydraulic hoses 5922 to the hydraulic motors 5700 that drive the sets of rotary tools 5200, and 2) through hydraulic hoses 5932 to a hydraulic motor 5934 that is provided to drive blending blades 5165 that are located inside the reservoir tank 5150 in the same manner as the blending blades 165 are located within and rotate within the reservoir tank 50.

While a vehicle-carried engine 5980 is depicted as being utilized to drive the vehicle-carried pumps 5920, 5950, it will be understood that a power take off drive (not shown) of the vehicle 5600, or some other form of vehicle-powered drive may be substituted as a source of power. Thus, the apparatus 5010 that is illustrated in FIG. 10 provides an example of a coating apparatus that is operated using, in essence, a vehicle-carried power source, with many of the components of the coating apparatus being vehicle-carried, and with even the carriage 5020 that supports the sets of rotary tools 5200 being connected to and supported by the vehicle (with no use being made of any attendant traffic-surface-engaging wheels that underlie the carriage 5020).

While the preferred embodiments that are depicted in the drawings and that is described later herein includes only one set, or a pair of sets of rotary tools, and defines only one center axis, or a pair of center axes, about which a set or sets of rotary tools rotate(s) to effect mixing, spreading and application of coating constituents, it will be understood by those who are skilled in the art that a multiplicity of rotary tool units, each rotating about a separate, substantially vertically extending center axis, can be utilized to advantage, for example in such "tandem" arrangements as are described and illustrated in the referenced Third Parent Case. In one form of practice, the "tandem" rotary tool units are arranged side-by-side so that, as the apparatus is moved forwardly along a path of travel, each of the side-by-side rotary tool units treats a separate portion of the width of a "treatment zone" or "travel path" that is traversed by the apparatus. In another form of practice, at least some of the rotary tool units are arranged relatively forwardly and rearwardly with respect to each other so that as the apparatus is moved forwardly along its travel path, the forward and rearward rotary tool units are brought sequentially into contact with portions of the treatment zone.

In still another form of practice, the forward rotary tool units can (through the use of their hollow stub shafts to duct coating constituents onto the traffic surface being coated) serve to effect a first center-fed dispensing and mixing in situ of selected coating constituents; and, the rearward tool units can (through the use of their hollow stub shafts to duct coating constituents onto the traffic surface being coated) serve to effect a second dispensing and mixing in situ of other selected coating constituents—whereby selected coating constituents can be deposited onto and at least partially mixed, spread and/or applied to a traffic surface before other selected coating constituents are deposited, mixed, spread and applied. Inasmuch as staged or separate deposits of coating ingredients often represent desirable approaches to use in effecting desired types of coating applications (e.g., in conjunction with applications of liquids that are to be mixed with particulates, or in conjunction with applications of constituents that harden or cure when mixed to form epoxy coatings, etc.), the use of staged center-fed sets of rotary tools represents a good example of how features that are disclosed in the referenced Parent Cases can be combined with features of the present invention to provide desired types of system performance.

Other advantages that can obtain through the use of features of the inventions of the referenced Parent Cases reside in the provision of finishing apparatus that is capable of effecting uniform, in situ mixing of coating ingredients that range in consistency from very thin, slurry-like liquids to very viscous tar-like gels and/or particulates. Where very viscous ingredients are being used, often it is desirable to utilize arrays of alternating mixing and spreading tools. By way of example (and as is described in detail in the referenced Parent Cases), rake-like mixing tools may be used to break up and mix particulate coating ingredients with viscous slurry coatings so that blade-like spreading tools can effect application of coating materials with a desired degree of uniformity.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of applying a substantially uniform coating composition to contiguous selected portions of a traffic surface, comprising the following steps that are performed substantially concurrently, including:

a) depositing a plurality of coating composition ingredients upon selected portions of a traffic surface to be coated;

b) operating a wheeled vehicle to which a coating apparatus is connected to move the vehicle-connected coating apparatus at a controlled forward velocity along a forward path of travel to bring a set of rotary tools of the vehicle-connected coating apparatus into contact with deposited coating composition ingredients, with the set of rotary tools including an associated rotary structure 1) having a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least said selected ones of the associated blades are permitted to move a limited amount relative to the associated rotary structure to accommodate the character of said selected portions of the traffic surface to maintain relatively close, substantially parallel contact with such selected portions of the traffic surface as are engaged by the associated blades;

c) rotating the set of rotary tools about its associated center axis at a controlled rate of tool rotation with at least said selected associated blades being urged into substantially continuous contact with said selected portions of the traffic surface and into contact with coating composition ingredients deposited thereon to effect a relatively rapid mixing of the deposited ingredients to achieve a condition of substantially uniform coating consistency;

d) applying to said selected traffic surface portions a coating of substantially uniform consistency that results from said mixing of said deposited ingredients, with the application being effected by continuing to rotate the set of rotary tools about its associated center axis at said controlled rate of tool rotation, with at least said selected associated blades moving relative to their associated rotary structure as is needed to conform to the contour of and to substantially maintain contact with said selected traffic surface portions;

e) with the aforedescribed steps that are performed substantially concurrently including the steps of:

i) mixing within a fluid reservoir at least a fluid portion of the coating composition ingredients that are to be deposited onto the selected traffic surface portions, with said mixing being effected at least in part by operating blender means within the fluid reservoir, and with the operation of the blender means serving to assist in maintaining the homogeneity of the fluid portion of the coating composition ingredients carried within the reservoir;

ii) ducting a regulated flow of said substantially homogenous fluid mixture of ingredients from the reservoir to and through a discharge station of the vehicle-connected coating apparatus so as to deposit the flow of ingredients onto selected traffic surface portions that underlie the discharge station; and, iii) operating the vehicle to move the vehicle-connected coating apparatus along said forward path of travel at said controlled forward velocity while rotating the set of rotary tools about its associated center axis at said controlled rate of tool rotation to thereby cause said set of rotary tools to engage, mix, spread and apply the deposited ingredients to effect the application of a substantially uniform coating to the contiguous surface area of said selected traffic surface portions during movement of the vehicle-connected coating apparatus along said forward path of travel;

f) wherein the step of ducting a regulated flow of said fluid mixture from said reservoir to said discharge station includes the step of providing pump means communicating with said reservoir and with said discharge station, and operating said pump means to duct a regulated flow of said fluid mixture from said reservoir to said discharge station during operation of the vehicle-connected coating apparatus while the vehicle-connected coating apparatus is being moved by the vehicle along said forward path of travel; and, g) wherein the step of operating said pump means includes the steps of providing pump drive means for transferring rotary drive energy from the vehicle to said pump means to drive said pump means, and operating said pump drive means to drive said pump means to effect said regulated flow of said fluid mixture from said reservoir to said discharge station during operation of the vehicle-connected coating apparatus while the vehicle-connected coating apparatus is being moved by the vehicle along said forward path of travel.

2. A method of applying a substantially uniform coating composition to contiguous selected portions of a traffic surface, comprising the following steps that are performed substantially concurrently, including:

a) depositing a plurality of coating composition ingredients upon selected portions of a traffic surface to be coated;

b) operating a wheeled vehicle to which a coating apparatus is connected to move the vehicle-connected coating apparatus at a controlled forward velocity along a forward path of travel to bring a set of rotary tools of the vehicle-connected coating apparatus into contact with deposited coating composition ingredients, with the set of rotary tools including an associated rotary structure 1) having a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least said selected ones of the associated blades are permitted to move a limited amount relative to the associated rotary structure to accommodate the character of said selected portions of the traffic surface to maintain relatively close, substantially parallel contact with such selected portions of the traffic surface as are engaged by the associated blades;

c) rotating the set of rotary tools about its associated center axis at a controlled rate of tool rotation with at least said selected associated blades being urged into substantially continuous contact with said selected portions of the traffic surface and into contact with coating composition ingredients deposited thereon to effect a relatively rapid mixing of the deposited ingredients to achieve a condition of substantially uniform coating consistency;

d) applying to said selected traffic surface portions a coating of substantially uniform consistency that results from said mixing of said deposited ingredients, with the application being effected by continuing to rotate the set of rotary tools about its associated center axis at said controlled rate of tool rotation, with at least said selected associated blades moving relative to their associated rotary structure as is needed to conform to the contour of and to substantially maintain contact with said selected traffic surface portions;

e) with the aforedescribed steps that are performed substantially concurrently including the steps of:

i) mixing within a fluid reservoir at least a fluid portion of the coating composition ingredients that are to be deposited onto the selected traffic surface portions, with said mixing being effected at least in part by operating blender means within the fluid reservoir, and with the operation of the blender means serving to assist in maintaining the homogeneity of the fluid portion of the coating composition ingredients carried within the reservoir;

ii) ducting a regulated flow of said substantially homogenous fluid mixture of ingredients from the reservoir to and through a discharge station of the vehicle-connected coating apparatus so as to deposit the flow of ingredients onto selected traffic surface portions that underlie the discharge station; and, iii) operating the vehicle to move the vehicle-connected coating apparatus along said forward path of travel at said controlled forward velocity while rotating the set of rotary tools about its associated center axis at said controlled rate of tool rotation to thereby cause said set of rotary tools to engage, mix, spread and apply the deposited ingredients to effect the application of a substantially uniform coating to the contiguous surface area of said selected traffic surface portions during movement of the vehicle-connected coating apparatus along said forward path of travel;

f) wherein the step of ducting a regulated flow of said fluid mixture from said reservoir to said discharge station includes the step of providing pump means communicating with said reservoir and with said discharge station, and operating said pump means to duct a regulated flow of said fluid mixture from said reservoir to said discharge station during operation of the vehicle-connected coating apparatus while the vehicle-connected coating apparatus is being moved by the vehicle along said forward path of travel; and, g) wherein the step of operating said pump means includes the steps of providing hydraulic motor drive means for delivering rotary drive energy to said pump means to drive said pump means, and operating said hydraulic motor drive means to drive said pump means to effect said regulated flow of said fluid mixture from said reservoir to said discharge station during operation of the vehicle-connected coating apparatus while the vehicle-connected coating apparatus is being moved by the vehicle along said forward path of travel.

3. A method of applying a substantially uniform coating composition to contiguous selected portions of a traffic surface, comprising the following steps that are performed substantially concurrently, including:

a) depositing a plurality of coating composition ingredients upon selected portions of a traffic surface to be coated;

b) operating a wheeled vehicle to which a coating apparatus is connected to move the vehicle-connected coating apparatus at a controlled forward velocity along a forward path of travel to bring a set of rotary tools of the vehicle-connected coating apparatus into contact with deposited coating composition ingredients, with the set of rotary tools including an associated rotary structure 1) having a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least said selected ones of the associated blades are permitted to move a limited amount relative to the associated rotary structure to accommodate the character of said selected portions of the traffic surface to maintain relatively close, substantially parallel contact with such selected portions of the traffic surface as are engaged by the associated blades;

c) rotating the set of rotary tools about its associated center axis at a controlled rate of tool rotation with at least said selected associated blades being urged into substantially continuous contact with said selected portions of the traffic surface and into contact with coating composition ingredients deposited thereon to effect a relatively rapid mixing of the deposited ingredients to achieve a condition of substantially uniform coating consistency;

d) applying to said selected traffic surface portions a coating of substantially uniform consistency that results from said mixing of said deposited ingredients, with the application being effected by continuing to rotate the set of rotary tools about its associated center axis at said controlled rate of tool rotation, with at least said selected associated blades moving relative to their associated rotary structure as is needed to conform to the contour of and to substantially maintain contact with said selected traffic surface portions;

e) with the aforedescribed steps that are performed substantially concurrently including the steps of:

i) mixing within a fluid reservoir at least a fluid portion of the coating composition ingredients that are to be deposited onto the selected traffic surface portions, with said mixing being effected at least in part by operating blender means within the fluid reservoir, and with the operation of the blender means serving to assist in maintaining the homogeneity of the fluid portion of the coating composition ingredients carried within the reservoir;

ii) ducting a regulated flow of said substantially homogenous fluid mixture of ingredients from the reservoir to and through a discharge station of the vehicle-connected coating apparatus so as to deposit the flow of ingredients onto selected traffic surface portions that underlie the discharge station; and, iii) operating the vehicle to move the vehicle-connected coating apparatus along said forward path of travel at said controlled forward velocity while rotating the set of rotary tools about its associated center axis at said controlled rate of tool rotation to thereby cause said set of rotary tools to engage, mix, spread and apply the deposited ingredients to effect the application of a substantially uniform coating to the contiguous surface area of said selected traffic surface portions during movement of the vehicle-connected coating apparatus along said forward path of travel;

f) providing reservoir support means for supporting said reservoir for movement along said forward path of travel in concert with movement therealong of the vehicle-connected coating apparatus; and, g) providing tool support means for supporting said set of rotary tools for rotation about its associated center axis at said controlled rate of tool rotation during operation of the vehicle-connected coating apparatus while the vehicle-connected coating apparatus is being moved by the vehicle along said forward path of travel.

4. The method of claim 3 wherein the step of providing tool support means includes the step of providing vehicle-connectable carriage means for supporting said set of rotary tools for rotation about its associated center axis relative to said carriage means during operation of the vehicle-connected coating apparatus while the vehicle-connected coating apparatus is being moved by the vehicle along said forward path of travel.

5. The method of claim 4 additionally including the step of maintaining said vehicle-connectable carriage means at a substantially uniform height above said selected portions of traffic surface that are to be coated during operation of the vehicle-connected coating apparatus while the vehicle-connected coating apparatus is being moved by the vehicle along said forward path of travel.

6. The method of claims 5 wherein the step of maintaining said vehicle-connectable carriage means at a substantially uniform height includes the step of providing carriage support means for rollingly-engaging traffic surface portions that underlie said carriage means so that at least a portion of the weight of said carriage means is supported by the rolling engagement of said carriage support means with said underlying traffic surface portions during operation of the vehicle-connected coating apparatus while the vehicle-connected coating apparatus is being moved by the vehicle along said forward path of travel.

7. The method of claim 5 wherein the step of maintaining said vehicle-connectable carriage means at a substantially uniform height includes the step of providing carriage support means for connecting said carriage means to said vehicle so that at least a portion of the weight of said carriage means is supported by the vehicle during operation of the vehicle-connected coating apparatus while the vehicle-connected coating apparatus is being moved by the vehicle along said forward path of travel.

8. A method of applying a substantially uniform coating composition to contiguous selected portions of a traffic surface, comprising the following steps that are performed substantially concurrently, including:

a) depositing a plurality of coating composition ingredients upon selected portions of a traffic surface to be coated;

b) operating a wheeled vehicle to which a coating apparatus is connected to move the vehicle-connected coating apparatus at a controlled forward velocity along a forward path of travel to bring a set of rotary tools of the vehicle-connected coating apparatus into contact with deposited coating composition ingredients, with the set of rotary tools including an associated rotary structure 1) having a plurality of associated depending blades that are arranged in an array about an associated center axis that extends substantially normal to the selected portions of the traffic surface, and 2) having connection means movably connecting at least selected ones of the associated blades to the associated rotary structure so that, when the set of rotary tools is rotated about the associated center axis, at least said selected ones of the associated blades are permitted to move a limited amount relative to the associated rotary structure to accommodate the character of said selected portions of the traffic surface to maintain relatively close, substantially parallel contact with such selected portions of the traffic surface as are engaged by the associated blades;

c) rotating the set of rotary tools about its associated center axis at a controlled rate of tool rotation with at least said selected associated blades being urged into substantially continuous contact with said selected portions of the traffic surface and into contact with coating composition ingredients deposited thereon to effect a relatively rapid mixing of the deposited ingredients to achieve a condition of substantially uniform coating consistency;

d) applying to said selected traffic surface portions a coating of substantially uniform consistency that results from said mixing of said deposited ingredients, with the application being effected by continuing to rotate the set of rotary tools about its associated center axis at said controlled rate of tool rotation, with at least said selected associated blades moving relative to their associated rotary structure as is needed to conform to the contour of and to substantially maintain contact with said selected traffic surface portions;

e) with the aforedescribed steps that are performed substantially concurrently including the steps of:

i) mixing within a fluid reservoir at least a fluid portion of the coating composition ingredients that are to be deposited onto the selected traffic surface portions, with said mixing being effected at least in part by operating blender means within the fluid reservoir, and with the operation of the blender means serving to assist in maintaining the homogeneity of the fluid portion of the coating composition ingredients carried within the reservoir;

ii) ducting a regulated flow of said substantially homogenous fluid mixture of ingredients from the reservoir to and through a discharge station of the vehicle-connected coating apparatus so as to deposit the flow of ingredients onto selected traffic surface portions that underlie the discharge station; and, iii) operating the vehicle to move the vehicle-connected coating apparatus along said forward path of travel at said controlled forward velocity while rotating the set of rotary tools about its associated center axis at said controlled rate of tool rotation to thereby cause said set of rotary tools to engage, mix, spread and apply the deposited ingredients to effect the application of a substantially uniform coating to the contiguous surface area of said selected traffic surface portions during movement of the vehicle-connected coating apparatus along said forward path of travel;

f) wherein the step of operating blender means within the fluid reservoir includes the step of rotating a plurality of blending blades that are disposed within the fluid reservoir, that are drivingly connected to and supported by a blender shaft that extends through selected portions of the reservoir, and that are rotatable in unison with the blender shaft when the blender shaft is rotated about a blender shaft axis along which the blender shaft extends substantially coaxially, with the rotation of the blender blades being effected by rotating the blender shaft about the blender axis, and with the rotation of the blender blades serving to stir, mix and blend the fluid mixture that is contained in the reservoir to assist in maintaining its homogeneity during operation of the vehicle-connected coating apparatus while the vehicle-connected coating apparatus is being moved by the vehicle along said forward path of travel.

9. The method of claim 8 wherein the step of rotating said blender shaft includes the steps of providing hydraulic motor drive means for rotating said blender shaft, and operating said hydraulic motor drive means to rotate said blender shaft about said blender shaft axis during operation of the vehicle-connected coating apparatus while the vehicle-connected coating apparatus is being moved by the vehicle along said forward path of travel.

10. The method of claim 8 or 9 wherein the step of rotating a plurality of blending blades by rotating said blender shaft about said blender shaft axis includes the step of maintaining the speed of rotation of said blender shaft about said blender shaft axis within the range of about 34 to about 53 revolutions per minute.

11. The method of claim 3, 4, 5, 6 or 7 wherein the step of providing reservoir support means includes the step of providing means for connecting said reservoir to the vehicle so that said reservoir is supported, at least in part, by the vehicle during operation of the vehicle-connected coating apparatus while the vehicle-connected coating apparatus is being moved by the vehicle along said forward path of travel.

12. The method of claim 3, 4, 5, 6 or 7 wherein the step of providing reservoir support means includes the step of providing means for connecting said reservoir to the carriage means so that said reservoir is supported, at least in part, by the carriage means during operation of the vehicle-connected coating apparatus while the vehicle-connected coating apparatus while the vehicle-connected coating apparatus is being moved by the vehicle along said forward path of travel.

13. The method of claim 1, 2, 3, 4, 5, 6, 7, 8 or 9 wherein the step of rotating said set of rotary tools about its associated center axis includes the steps of providing tool drive means for transferring rotary drive energy from the vehicle to said set of rotary tools to drive said set of rotary tools, and operating said power drive means to rotate said set of rotary tools about its associated center axis at said controlled rate of tool rotation during operation of the vehicle-connected coating apparatus while the vehicle-connected coating apparatus is being moved by the vehicle along said forward path of travel.

14. The method of claim 1, 2, 3, 4, 5, 6, 7, 8 or 9 wherein the step of rotating said set of rotary tools about its associated center axis includes the steps of a) providing tool drive means including a source, of rotary energy to drive said set of rotary tools for rotating the set of rotary tools about its associated center axis as the vehicle-connected coating apparatus is moved by the vehicle along said forward path of ravel, b) providing source support means for connecting said tool drive means to the vehicle so that at least a portion of said tool drive means is supported by the vehicle, and c) operating said tool drive means to rotate said set of rotary tools about its associated center axis at said controlled rate of tool rotation during operation of the vehicle-connected coating apparatus while the vehicle-connected coating apparatus is being moved by the vehicle along said forward path of travel.

15. The method of claim 1, 2, 3, 4, 5, 6, 7, 8 or 9 wherein the step of rotating said set of rotary tools about its associated center axis includes the steps of a) providing tool drive means including a source of rotary energy to drive said set of rotary tools for rotating the set of rotary tools about its associated center axis as the vehicle-connected coating apparatus is moved by the vehicle along said forward path of travel, b) providing source support means for connecting said tool drive means to the carriage means so that at least a portion of said tool drive means is supported by the carriage means, and c) operating said tool drive means to rotate said set of rotary tools about its associated center axis at said controlled rate of tool rotation during operation of the vehicle-connected coating apparatus while the vehicle-connected coating apparatus is being moved by the vehicle along said forward path of travel.

16. The method of claim 1, 2, 3, 4, 5, 6, 7, 8 or 9 wherein the step of rotating said set of rotary tools about its associated center axis includes the steps of a) providing tool drive means in the form of hydraulic motor means that is drivingly connected to said set of rotary tools for rotating said set of rotary tools about its associated center axis at said controlled rate of tool rotation, b) providing hydraulic pump means for connection to a source of rotary energy for providing a supply of pressurized hydraulic fluid to said hydraulic motor means to operate said hydraulic motor means to rotate the set of rotary tools about its associated center axis at said controlled rate of tool rotation, and c) operating said tool drive means to rotate said set of rotary tools about its associated center axis at said controlled rate of tool rotation during operation of the vehicle-connected coating apparatus while the vehicle-connected coating apparatus is being moved by the vehicle along said forward path of travel.

17. The method of claim 1, 2, 3, 4, 5, 6, 7, 8 or 9 wherein the step of operating the vehicle to move the vehicle-connected coating apparatus along said forward path of travel at said controlled forward velocity includes the step of maintaining said controlled forward velocity within the range of about 1.7 to about 2.7 miles per hour.

18. The method of claim 1, 2, 3, 4, 5, 6, 7, 8 or 9 wherein the step of rotating the set of rotary tools about its associated center axis at said controlled rate of tool rotation includes the step of maintaining said controlled rate of tool rotation within the range of about 42 to about 66 revolutions per minute during operation of the vehicle-connected coating apparatus while the vehicle-connected coating apparatus is being moved by the vehicle along said forward path of travel.

19. The method of claim 1, 2, 3, 4, 5, 6, 7, 8 or 9 wherein the step of operating the vehicle to move the vehicle-connected coating apparatus along said forward path of travel at said controlled forward velocity, and the step of rotating the set of rotary tools about its associated center axis at said controlled rate of tool rotation includes the step of maintaining a substantially constant ratio of about 1 to 25 between said controlled forward velocity as measured in miles per hour at and said controlled rate of tool rotation as measured in revolutions per minute, whereby, for example, when said controlled forward velocity is maintained at about 1.7 miles per hour, said controlled rate of tool rotation is maintained at about 42.5 revolutions per minute.

20. The method of claim 1, 2, 3, 4, 5, 6, 7, 8 or 9 wherein the step of ducting a regulated flow of said fluid mixture to and through said discharge station includes the steps of providing structure for defining said discharge station at a location substantially centrally among said rotating, depending blades of said set of rotary tools, and ducting said flow substantially along the associated center axis of said set of rotary tools for discharge through said discharge station substantially centrally among said rotating, depending blades of said set of rotary tools during operation of the vehicle-connected coating apparatus while the vehicle-connected coating apparatus is being moved by the vehicle along said forward path of travel.

21. A traffic surface coated substantially uniformly in accordance with the method of claim 1, 2, 3, 4, 5, 6, 7, 8, 9.

22. Coating apparatus for attachment to a wheeled vehicle for being moved by the vehicle across contiguous selected portions of a traffic surface that are to be coated by applying thereto a substantially uniform coating composition consisting of plural ingredients, the apparatus comprising:

a) carriage means including frame, frame connection means for connecting the frame to the wheeled vehicle, and frame support means for connecting the frame for supporting the frame atop a traffic surface for movement of the frame by the vehicle along a forward path of travel across selected portions of the traffic surface that are to be coated, with the carriage means defining at least one associated center axis that extends substantially normal to such portions of the traffic surface as underlie the frame as the frame is moved by the vehicle along said forward path of travel;

b) supply source means for defining a reservoir for containing fluid coating constituents that are to be applied to the traffic surface, with the supply source means having blender means for extending into such fluid coating constituents as are carried within said reservoir to mix and blend such constituents to facilitate maintaining the homogeneity thereof;

c) dispensing means connected to the frame and including:

i) associated tubular conduit means including a hollow tubular member that is associated with said associated center axis for communicating with said reservoir and for extending along said associated center axis for defining an associated discharge opening that is located along said associated center axis and is spaced above such traffic surface portions as underlie the frame; and, ii) associated valve means connected to said associated tubular for selectively permitting and regulating the flow of coating constituents from said reservoir for discharge through said associated discharge opening onto such traffic surface portions as underlie said said associated discharge opening;

d) applicator means for mixing in situ on such traffic surface portions as underlie the frame such coating constituents as are discharged through said associated discharge opening, and for spreading and applying the resulting coating composition in a substantially uniform manner onto said contiguous selected portions of the traffic surface, with the applicator means including an associated set of rotary tools that is associated with said associated center axis and includes:

i) an associated rotary structure that extends about and is movably connected to said associated hollow tubular member for being rotated about said associated center axis;

ii) a plurality of associated depending blades that are arranged in an array about said associated center axis;

iii) connection means for movably interconnecting at least selected ones of the associated blades to the associated rotary structure for permitting limited movements of said selected ted blades relative to said associated rotary structure so as to accommodate the character of said selected portions of the traffic surface that are being coated by the operation of said blades, and to maintain relatively close, substantially parallel contact with such portions of the traffic surface as the carriage means moves along said forward path of travel; and, e) power drive means for connecting to said associated rotary structure to a source of rotary energy for imparting rotary drive energy to said associated rotary structure for rotating said set of rotary tools about said associated center axis at a controlled rate of tool rotation with at least said selected ones of the associated blades being permitted to move a limited amount relative to the associated rotary structure to accommodate the character of said selected portions of the traffic surface as are engaged by the associated blades.

23. The coating apparatus of claim 22 additionally including pump means communicating with said associated tubular conduit means for being operated to duct a regulated flow of said fluid mixture from said reservoir to said associated discharge opening for discharge therethrough during operation of the coating apparatus while the coating apparatus is being moved by the vehicle along said forward path of travel.

24. The coating apparatus of claim 23 additionally including pump drive means for connecting with a source of rotary energy to transfer rotary energy to said pump means to operate said pump means to effect said regulated flow of said fluid mixture from said reservoir to and through said associated discharge opening while the coating apparatus is being moved by the vehicle along said forward path of travel.

25. The coating apparatus of claim 24 wherein said pump drive means includes hydraulic motor drive means for delivering rotary drive energy to said pump means to drive said pump means.

26. The coating apparatus of claim 22 additionally including reservoir support means for connection to a selected one of the vehicle and the frame for, and to the supply source means, so that said supply source means is supported at least in part by said selected one of the vehicle and the frame while the coating apparatus is being moved by the vehicle along said forward path of travel.

27. The coating apparatus of claim 22 wherein said frame support means includes rollable support means for rollingly-engaging traffic surface portions that underlie said frame for supporting at least a portion of said frame by the rolling engagement of said rollable support means with said underlying traffic surface portions.

28. The coating apparatus of claim 22 wherein said frame support means is defined, at least in part, by said frame connection means which also functions to support at least a portion of said frame from said vehicle.

29. The coating apparatus of claim 22 additionally including blender drive means for transferring rotary energy to the blender means for operating the blender means to mix and blend such coating constituents as are contained within said reservoir.

30. The coating apparatus of claim 22, 23, 24, 25, 26, 27, 28 or 29 wherein said power drive means is adapted for connection to a source of rotary drive energy that is connected to and is carried at least in part by the vehicle for rotating said associated set of rotary tools about its associated center axis at said controlled rate of tool rotation while the coating apparatus is being moved by the vehicle along said forward path of travel.

31. The coating apparatus of claim 22, 23, 24, 25, 26, 27, 28 or 29 wherein said power drive means is connected to a source of rotary drive energy that is connected to and is carried at least in part by the frame for rotating said associated set of rotary tools about its associated center axis at said controlled rate of tool rotation while the coating apparatus is being moved by the vehicle along said forward path of travel.

32. The coating apparatus of claim 22, 23, 24, 25, 26, 27, 28 or 29 wherein said power drive means includes a) hydraulic motor means for being drivingly connected to said associated set of rotary tools, and b) hydraulic pump means for connection to said source of rotary energy for delivering pressurized hydraulic fluid to said hydraulic motor means to operate said hydraulic motor means to rotate said associated set of rotary tools about its associated center axis at said controlled rate of tool rotation while the coating apparatus is being moved by the vehicle along said forward path of travel.

* * * * *